US007268746B2

(12) United States Patent
Yoshida

(10) Patent No.: US 7,268,746 B2
(45) Date of Patent: Sep. 11, 2007

(54) ACTIVE MATRIX SUBSTRATE AND DISPLAY

(75) Inventor: Masahiro Yoshida, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 485 days.

(21) Appl. No.: 10/699,803

(22) Filed: Nov. 4, 2003

(65) Prior Publication Data

US 2004/0100431 A1 May 27, 2004

(30) Foreign Application Priority Data

Nov. 25, 2002 (JP) ..... 2002-341560

(51) Int. Cl.
*G09G 5/00* (2006.01)
*G09G 3/36* (2006.01)

(52) U.S. Cl. ..... 345/1.1; 345/87

(58) Field of Classification Search ..... 345/55, 345/76, 82, 84, 87, 1.1–4, 204, 3.1, 1.3; 349/56, 349/139, 151–152, 142; 315/169.1–169.4
See application file for complete search history.

(56) References Cited

U.S. PATENT DOCUMENTS 6,677,925 B1 * 1/2004 Kawaguchi et al. ..... 345/98
6,954,184 B2 * 10/2005 Kurashima et al. ..... 345/1.3
2004/0021616 A1 2/2004 Goto et al.

FOREIGN PATENT DOCUMENTS

JP 7-168208 A 7/1995
JP 2000-250064 A 9/2000
KP 10-2004-0011378 2/2004

* cited by examiner

*Primary Examiner*—Amr A. Awad
*Assistant Examiner*—Stephen G. Sherman
(74) *Attorney, Agent, or Firm*—Birch, Stewart, Kolasch & Birch, LLP

(57) ABSTRACT

A display 1 has two display panels 2, 3 each including an active matrix substrates 7, 8 including: source bus lines 4, 5 and gate bus lines 9 arranged to form a matrix; TFTs provided near respective intersections of the source bus lines 4, 5 and the gate bus lines 9; and pixel electrodes electrically connected to the source bus lines and the gate bus lines through the TFT. Of the source bus lines 4, 5, the source bus lines 5 are shared for use between the two active matrix substrates 7, 8. Meanwhile, the source bus lines 4 provided only to the active matrix substrate 7 have capacitances 6*a*, 6*b* formed thereon. Thus, the display with two display panels is prevented from developing block split and other display defects.

28 Claims, 25 Drawing Sheets

ACTIVE MATRIX SUBSTRATE AND DISPLAY

This Nonprovisional application claims priority under 35 U.S.C. § 119(a) on Patent Application No(s) 2002-341560 filed in Japan on Nov. 25, 2002, the entire contents of which are hereby incorporated by reference.

FIELD OF THE INVENTION

The present invention generally relates to active matrix substrates for use with the liquid crystal, organic light emitting diode, or inorganic light emitting diode as a display medium, and displays incorporating those active matrix substrates, and in particular, to active matrix substrates for use in a display with multiple display panels and such displays.

BACKGROUND OF THE INVENTION

Recent years have seen a beginning of widespread use of, for example, "twin panel" mobile telephones and similar displays equipped with two display panels. FIG. 25 shows an example. As in FIG. 25, a twin-panel display 181 has a main panel 182 and a sub-panel 183.

The main panel 182 includes a TFT substrate 184 which is a board carrying thin film transistors (TFTs) 192 thereon; an opposite substrate 185 placed opposite to the TFT substrate 184; and a liquid crystal layer (LC) 194 as a display medium sandwiched between the TFT substrate 184 and the opposite substrate 185.

On the TFT substrate 184 are there provided gate bus lines 188 and source bus lines 189. TFTs 192 are laid out near the intersections of the gate bus lines 188 and the source bus lines 189. The TFT 192 is connected to a gate bus line 188 at the gate, a source bus line 189 at the source, and a pixel electrode at the drain. A voltage is then applied to the LC (pixel) 194 between the pixel electrode and a common electrode (COM) 193 on the opposite substrate 185. All the TFTs 192 undergo the same process, displaying an image.

The main panel 182 further includes a gate driver 190 and a source driver 191. The lines extending from the gate driver 190 are connected to the gate bus lines 188, and those extending from the source driver 191 are connected to the source bus lines 189, so that the gate driver 190 and the source driver 191 can apply gate signal voltages and source signal voltages to respective bus lines.

The sub-panel 183 includes a TFT substrate 186 which is a board carrying thin film transistors 192 thereon; an opposite substrate 187 placed opposite to the TFT substrate 186; and a liquid crystal layer (LC) 194 as a display medium sandwiched between the TFT substrate 186 and the opposite substrate 187.

The sub-panel 183 is connected to the main panel 182 through, for example, an FPC (flexible printed circuit) not shown in the figure. The connection enables the gate driver 190 and the source driver 191 on the main panel 182 to apply gate signal voltages and source signal voltages to the bus lines on the sub-panel 183 through, for example, the wiring on the main panel 182 and the FPC.

The TFT substrate 186 is provided with gate bus lines 188 and source bus lines 189. TFT 192 are laid out near the intersections of the gate bus lines 188 and the source bus lines 189. The TFT 192 is connected to a gate bus line 188 at the gate, a source bus line 189 at the source, and a pixel electrode at the drain. A voltage is then applied to the LC (pixel) 194 between the pixel electrode and a common electrode (COM) 193 on the opposite substrate 187. All the TFTs 192 undergo the same process, displaying an image.

Thus, the main panel 182 and the sub-panel 183 can display an image. The shared bus lines to the main panel 182 and the sub-panel 183 are not limited to the source bus lines 189 in FIG. 25; they may be the gate bus lines.

As to conventional active matrix liquid crystal displays, for example, Japanese Published Unexamined Patent Application 7-168208 (Tokukaihei 7-168208/1995; published on Jul. 4, 1995) discloses an arrangement in which drive signals are fed through coupling capacitances which are made almost equal to one another. The arrangement produces a display free from irregularities.

In the twin-panel display 181, the main panel 182 suffers block split and other defects in image display due to delays of source signals on some source bus lines.

Specifically, as shown in FIG. 25, the twin panel 181 has different numbers of source bus lines 189 for the main panel 182 and the sub-panel 183. Those for the main panel 182 are divided into two groups: a first group 195 of lines that is shared with the sub-panel 183 and a second group 196 of lines that is not.

The first group 195 of lines is capacitance loaded by the sub-panel 183, as well as by the main panel 182, upon driving the main panel 182; therefore, supposing that the main panel 182 has a capacitance of 20 pF and the sub-panel has a capacitance of 10 pF, the capacitance for the first group 195 of lines is 30 pF. On the other hand, the second group 196 of lines is not capacitance loaded by the sub-panel 183; therefore, the capacitance for each one of the second group 196 of lines is 20 pF.

Upon producing a display on the main panel 182, the difference in capacitance renders differences in source signal delays distinct between the boundary between the first and second groups 195, 196, causing block split and other display defects. "Block split" is an irregular display which occurs in a certain block of a display panel, and caused by difference in delay among signals on lines arranged to form a matrix in the display panel.

SUMMARY OF THE INVENTION

The present invention, in view of the problems above, has an objective to offer an active matrix substrate for use in a display with multiple display panels sharing bus lines, free from block split and other display defects, as well as a display incorporating such an active matrix substrate.

To solve the problems, an active matrix substrate according to the present invention is an active matrix substrate including: first bus lines and second bus lines arranged to form a matrix; switching devices provided near respective intersections of the first bus lines and the second bus lines; and pixel electrodes electrically connected to the first bus lines and the second bus lines through the switching devices, and characterized in that: at least one of the first bus lines has a first capacitance formed thereon; and the first bus lines, except for the at least one first bus line with a first capacitance, are connected to first bus lines on another active matrix substrate.

The active matrix substrate is, for example, used as a display panel, incorporated in a display, in which the opposite substrate carrying a common electrode is placed opposite the surface carrying pixel electrodes, with a display medium sandwiched between the active matrix substrate and the opposite substrate. Further, for example, a source driver driving the first bus lines and a gate driver driving the second bus lines are connected to the first bus lines and the second bus lines respectively. The gate driver and the source driver apply a gate signal voltage and a source signal voltage through the respective bus lines. Thus, a desired voltage is applied through the pixel electrodes to the display medium, effecting a display.

The active matrix substrate includes a first capacitance formed on at least one of the first bus lines. The first bus lines, except for the one with a first capacitance, are connected to first bus lines on another active matrix substrate.

The arrangement enables the active matrix substrate to connect to, and share the first bus lines with, the other active matrix substrate. As discussed in the foregoing, the foregoing active matrix substrate and another active matrix substrate sharing the first bus lines allow for a narrower "frame" part around the display area of a display equipped with both the foregoing active matrix substrate and another active matrix substrate. In addition, the sharing reduce the number of drivers and output terminals for driving the first bus lines, thus realizing a display with an inexpensive and compact display module.

Further, the active matrix substrate has a first capacitance formed on the first bus lines not shared with the other active matrix substrate. The formation, when a display is to be produced using the active matrix substrate, eliminates or reduces capacitance difference from one first bus line to the other. Thus, free from block split and other display defects which could be caused by a signal delay difference among the first bus lines, a good display can be produced both on the active matrix substrate and on the other active matrix substrate.

A display according to the present invention is a display including display panels each including an active matrix substrate including: first bus lines and second bus lines arranged to form a matrix; switching devices provided near respective intersections of the first bus lines and the second bus lines; and pixel electrodes electrically connected to the first bus lines and the second bus lines through the switching devices, and is characterized in that: at least one of the first bus lines has a first capacitance formed thereon; and the first bus lines, except for the at least one first bus line with a first capacitance, are shared for use among the active matrix substrates in the display panels.

The display has display panels each including an active matrix substrate capable of producing an image display using a display medium such as a liquid crystal, organic light emitting diodes, or inorganic light emitting diodes. The display may be used, for example, in twin-panel mobile telephones.

In the display, each active matrix substrate in the display panels has first bus lines and second bus lines arranged to form a matrix. Further, for example, a source driver driving the first bus lines and a gate driver driving the second bus lines are connected to the first bus lines and the second bus lines respectively. The gate driver and the source driver apply a gate signal voltage and a source signal voltage through the respective bus lines. Thus, a desired voltage is applied through the pixel electrodes to the display medium, effecting a display. In the display, the driver driving the first bus lines may be the gate driver, and the driver driving the second bus lines may be the source driver.

In the display, at least one of the first bus lines has a first capacitance formed thereon; and the first bus lines, except for the at least one first bus line with a first capacitance, are shared for use among the active matrix substrates in the display panels.

The active matrix substrates in the display panels sharing the first bus lines allow for a narrower "frame" part around the display area of the display. In addition, the sharing reduce the number of drivers and output terminals for driving the first bus lines, thus realizing a display with an inexpensive and compact display module.

Further, in the display, the first bus lines not shared for use among the display panels, i.e., those which are provided only on the active matrix substrate of one of the display panels have a first capacitance formed thereon. The formation, when a display is to be produced using a display device with display panels with different numbers of display pixels, eliminates or reduces capacitance difference from one first bus line to the other. Thus, free from block split and other display defects which could be caused by a signal delay difference among the first bus lines, a good display can be produced on all the display panels.

Another display according to the present invention is a display including display panels each including an active matrix substrate-including: first bus lines and second bus lines arranged to form a matrix; switching devices provided near respective intersections of the first bus lines and the second bus lines; and pixel electrodes electrically connected to the first bus lines and the second bus lines through the switching devices, and is characterized in that: the first bus lines are shared for use among the display panels; in at least one of the display panels, at least one of the first bus lines is connected to none of the pixel electrodes on the active matrix substrate; and the at least one first bus line connected to none of the pixel electrodes has a first capacitance formed thereon.

The display has display panels each including an active matrix substrate capable of producing an image display using a display medium such as a liquid crystal, organic light emitting diodes, or inorganic light emitting diodes. The display may be used, for example, in twin-panel mobile telephones.

In the display, each active matrix substrate in the display panels has first bus lines and second bus lines arranged to form a matrix. Further, for example, a source driver driving the first bus lines and a gate driver driving the second bus lines are connected to the first bus lines and the second bus lines respectively. The gate driver and the source driver apply a gate signal voltage and a source signal voltage through the respective bus lines. Thus, a desired voltage is applied through the pixel electrodes to the display medium, effecting a display. In the display, the driver driving the first bus lines may be the gate driver, and the driver driving the second bus lines may be the source driver.

In the display, the first bus lines are shared for use among the display panels. According to the arrangement, the active matrix substrates in the display panels sharing the first bus lines for use allows for a narrower "frame" part around the display area. In addition, the sharing reduce or eliminates the number of drivers and output terminals for driving the first bus lines, thus realizing a display with an inexpensive and compact display module.

Further, in the display, the at least one first bus line connected to none of the pixel electrodes on the display panels has a first capacitance formed thereon. For example, when no first bus lines on a smaller display panel are connected to the pixel electrodes in a display device with display panels with different numbers of display pixels, capacitance difference from one first bus line to the other can be eliminated or reduced, because the first bus lines have a capacitance formed thereon. Thus, free from block split and other display defects which could be caused by a signal delay difference among the first bus lines, a good display can be produced on all the display panels.

Additional objects, advantages and novel features of the invention will be set forth in part in the description which follows, and in part will become apparent to those skilled in the art upon examination of the following or may be learned by practice of the invention.

BRIEF DESCRIPTION OF THE DRAWINGS

FIG. 24(*b*) is a magnified view of portion B in FIG. 24(*a*); and FIG. 24(*c*) is a magnified view of portion C in FIG. 24(*a*).

DESCRIPTION OF THE EMBODIMENTS

The following will describe various embodiments of the present invention which are by no means intended to limit the present invention.

The embodiments of the present invention will describe, as an example of active matrix substrates according to the present invention, active matrix substrates made up of TFTs (thin film transistors), TFDs (thin film diodes) or other active switching devices, for use in an inside panel (main panel) and an outside panel (sub-panel) of a foldable mobile telephone. In addition, the present embodiment will describe, as an example of displays according to the present invention, foldable mobile telephones and other similar displays with an inside panel (main panel) including such an active matrix substrate and an outside panel (sub-panel) including another active matrix substrate connected to the active matrix substrate through source bus lines.

Embodiment 1

First, embodiment 1 of the present invention will be discussed.

Figure 1:
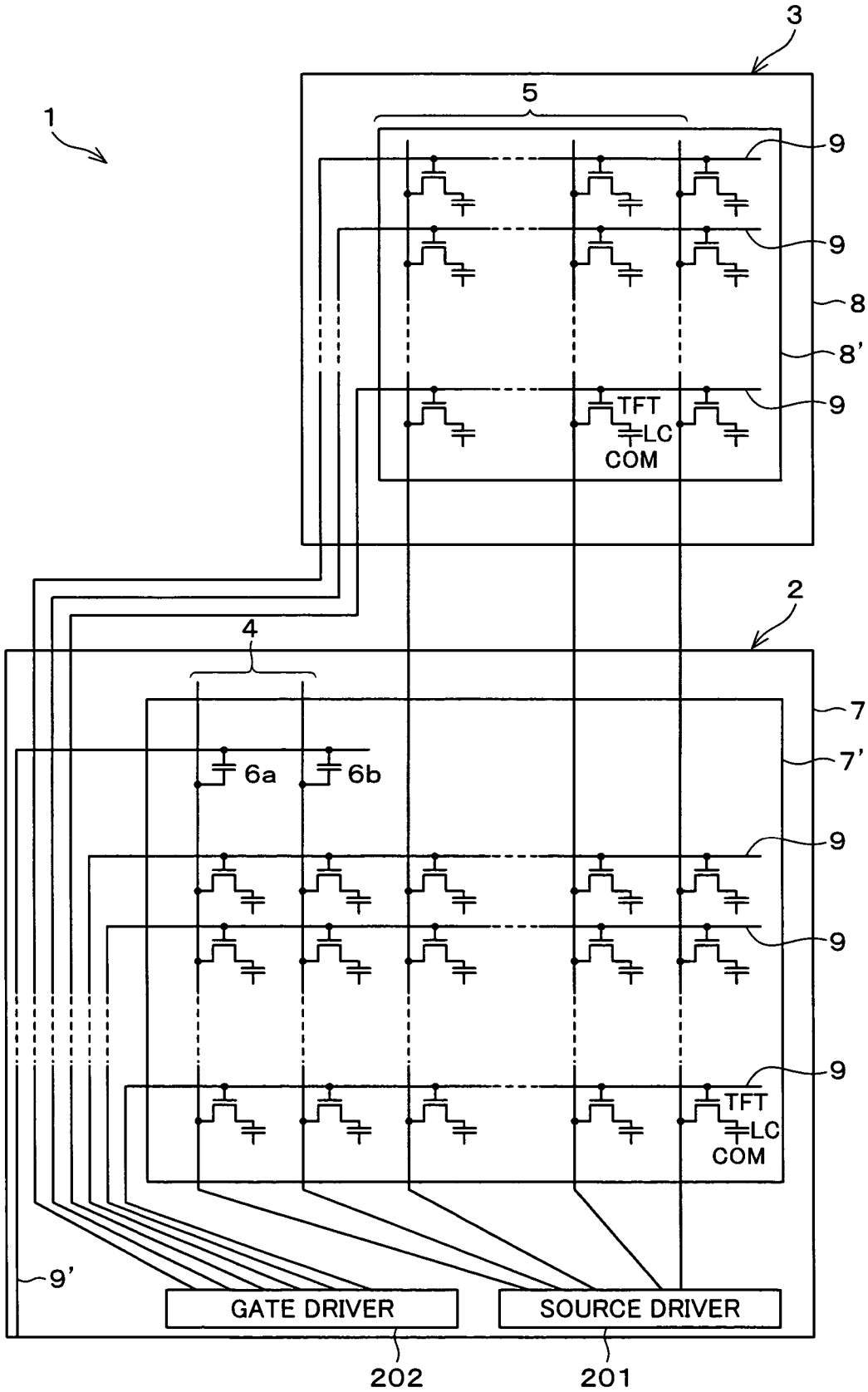
FIG. 1 is a circuit diagram showing an arrangement of a display of embodiment 1 according to the present invention.

FIG. 1 is a circuit diagram showing an arrangement of a display 1 of present embodiment 1. The display 1 of the present embodiment is made up of two parts of different sizes: a main panel which is the main display screen for the display 1 and a sub-panel with less display pixels than the main panel. This feature of the display 1 is specifically shown in FIG. 1 as the main panel (display panel) 2 and the sub-panel (display panel) 3. The main panel 2 includes a TFT substrate (active matrix substrate) 7 which is a board carrying thin film transistors (TFTs); an opposite substrate 7' placed opposite to the TFT substrate 7; and a liquid crystal layer (LC) as a display medium sandwiched between the TFT substrate 7 and the opposite substrate 7'.

On the TFT substrate 7 are there provided source bus lines (first bus lines) 4, 5 and gate bus lines (second bus lines) 9 in a matrix. TFTs (switching devices) are laid out near the intersections of the source bus lines 4, 5 and the gate bus lines 9. The TFT is connected to a gate bus line 9 at the gate, a source bus line 4, 5 at the source, and a pixel electrodes (not shown in the figure) at the drain. A voltage is then applied to the liquid crystal layer (LC) as a pixel between the pixel electrode and a common electrode (COM) on the opposite substrate 7'. All the TFTs undergo the same process, displaying an image.

The main panel 2 further includes a source driver 201 and a gate driver 202. The lines extending from the source driver 201 are connected to the source bus lines 4, 5, and those extending from the gate driver 202 are connected to the gate bus lines 9, so that the source driver 201 and the gate driver 202 can apply source signal voltages and gate signal voltages to respective bus lines.

The sub-panel 3 includes a TFT substrate (active matrix substrate) 8 which is a board carrying thin film transistors thereon; an opposite substrate 8' placed opposite to the TFT substrate 8; and a liquid crystal layer (LC) as a display medium sandwiched between the TFT substrate 8 and the opposite substrate 8'.

The sub-panel 3 is connected to the main panel through, for example, an FPC (flexible printed circuit) not shown in the figure. The connection enables the source driver 201 and the gate driver 202 on the main panel 2 to apply source signal voltages and gate signal voltages to the bus lines on the sub-panel 3 through, for example, the wiring and FPC on the main panel 2.

Similarly to the main panel 2, the TFT substrate 8 of the sub-panel 3 is provided thereon with source bus lines 5 and gate bus lines 9 in a matrix. TFTs are laid out near the intersections of the source bus lines 5 and the gate bus lines 9. The TFT is connected to a gate bus line 9 at the gate, a source bus line 5 at the source, and a pixel electrode (not shown in the figure) at the drain. A voltage is then applied to the liquid crystal layer (LC) as a pixel between the pixel electrode and a common electrode (COM) on the opposite substrate 8'. All the TFTs undergo the same process, displaying an image.

As in the foregoing, the main panel 2 and the sub-panel 3 can display an image. Incidentally, the main panel 2 and the sub-panel 3 have different numbers of source bus lines. The source bus lines 5 are shared for use by the main panel 2 and the sub-panel 3, and the source bus lines 4 are only for the main panel 2. The source bus lines 5 are therefore capacitance loaded by the sub-panel 3, as well as by the main panel 2, upon driving the main panel 2. On the other hand, the source bus lines 4 are capacitance loaded only by the main panel 2 upon driving the main panel 2.

To eliminate or reduce the difference in capacitance sufficiently so that it does not affect the display, the source bus lines 4, disposed only on the TFT substrate 7 for the main panel 2, are provided with supplemental capacitances (first capacitances) 6*a*, 6*b*. In the display 1 of the present embodiment, the capacitances are formed by the source bus lines 4 and common signal lines 9' crossing separated by, for example, intervening insulating films as shown in FIG. 1. Preferably the values of the capacitances 6*a*, 6*b* are chosen such that they can either eliminate or sufficiently reduce the capacitance difference between the source bus lines 4 and the source bus lines 5. The choice allows for no difference between the signal delay on the source bus lines 4 and that on the source bus lines 5, preventing display defects and other inconveniences from occurring due to signal delay difference. The values of the capacitances 6*a*, 6*b* may be equal to each other or have such small difference that it does not affect the display.

Now, it will be described how the capacitances are formed. Methods are divided into two major categories: one of them enlarges the area of the existent line intersections, and the other provides new lines to form the supplemental capacitances. A specific example of the first category is to increase the width of either the bus lines or the lines crossing them.

In the following, examples will be more specifically described of the method of forming the supplemental capacitances with reference to FIGS. 2 and 24(*a*)-24(*c*). The examples are based on combination of the above two categories.

Figure 2:
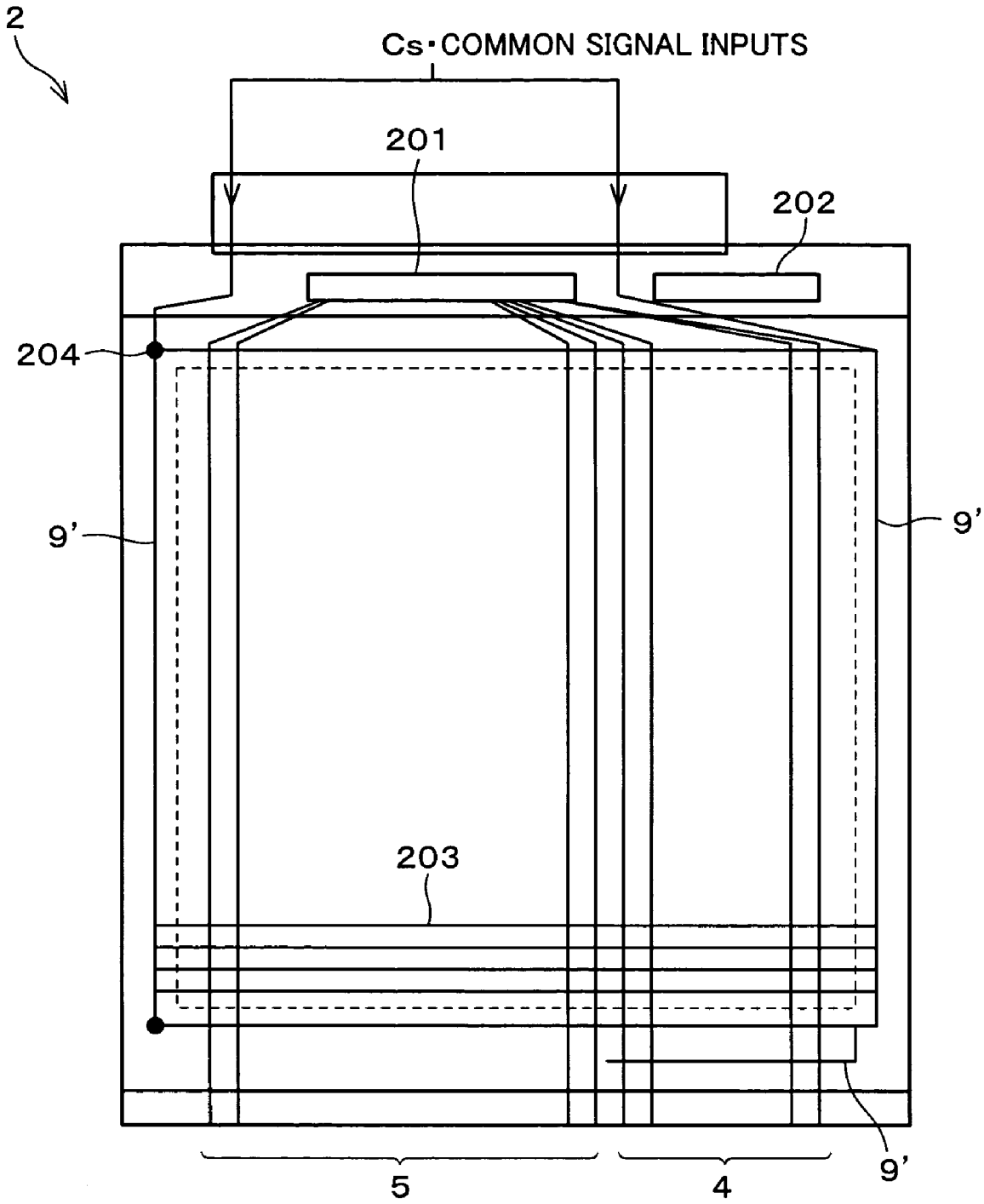
FIG. 2 is a schematic showing the layout of lines which provide supplemental capacitance on a main panel of a display of embodiment 1 according to the present invention.

FIG. 2 is a schematic showing the layout of the supplemental capacitance lines 9' on the main panel 2 of the display 1 of the present embodiment. Referring to FIG. 2, on the main panel 2 are there provided lines acting as both Cs signal lines and common signal lines (Cs/common signal lines 9').

Here the "Cs" refers to an isolated storage capacitance provided to improve display quality, because the pixel capacitance alone would be unstable in charge storage action and easily affected by a parasitic capacitance. The "Cs signal line" refers to a line feeding a signal to one of Cs bus lines 203 in the "Cs-on-Com" structure. The "common signal line" refers to a line feeding a signal to a common electrode through a common transfer section 204 in the same structure. The Cs/common signal line 9' refers to a line transmitting external signals to the main panel 2.

The Cs-on-Com structure provides Cs on dedicated lines (Cs bus lines) which cross drain electrodes with, for example, an insulating film there between. The dedicated lines may be connected to the common signal lines. Another structure, termed "Cs-on-Gate," provides Cs on the gate bus lines which cross drain electrodes with, for example, an insulating film there between. No Cs signal lines are present in the Cs-on-Gate structure.

As previously mentioned, the main panel 2 has the source driver 201, and the source bus lines 4, 5 are disposed extending from the source driver 201 to the display area (surrounded by a dashed line in FIG. 2) of the main panel 2. Among the source bus lines, those which are connected to the sub-panel 3 through, for example, an FPC are the source bus lines 5, and those which are not are the source bus lines 4. In the main panel 2, the supplemental capacitance lines 9' providing capacitances 6*a*, 6*b* are connected to the common signal lines 9' and cross only the source bus lines 4.

Figure 24:
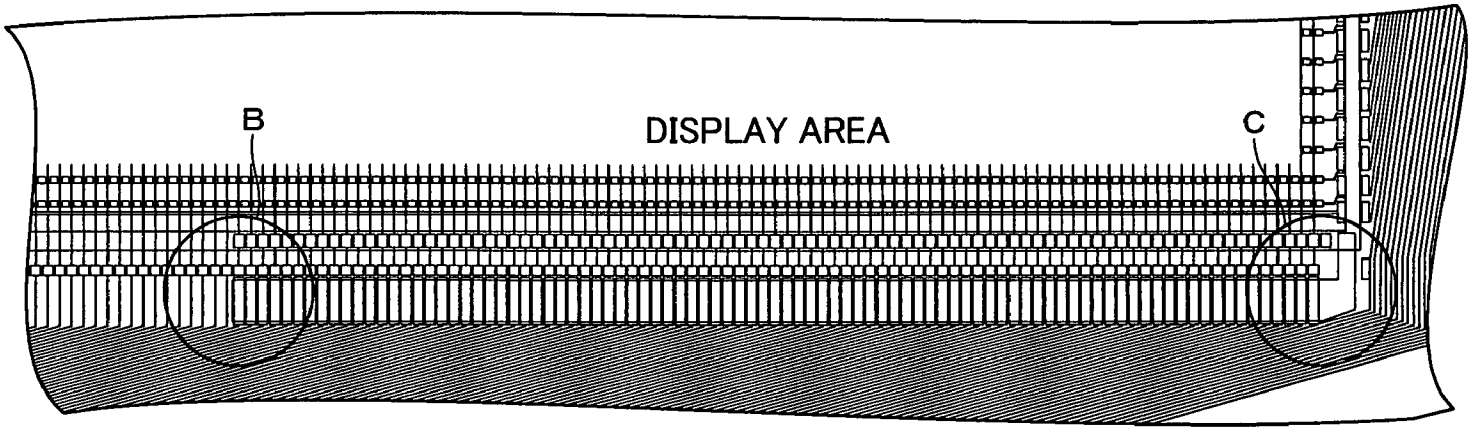
FIG. 24(*a*) is a schematic more specifically showing a structure of supplemental capacitance lines for the main panel of the display of embodiment 1 according to the present invention.
Figure 24:
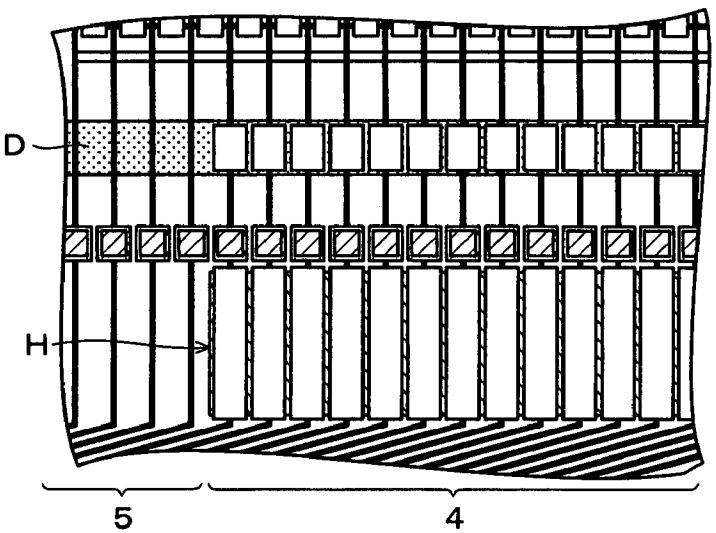
Figure 24:
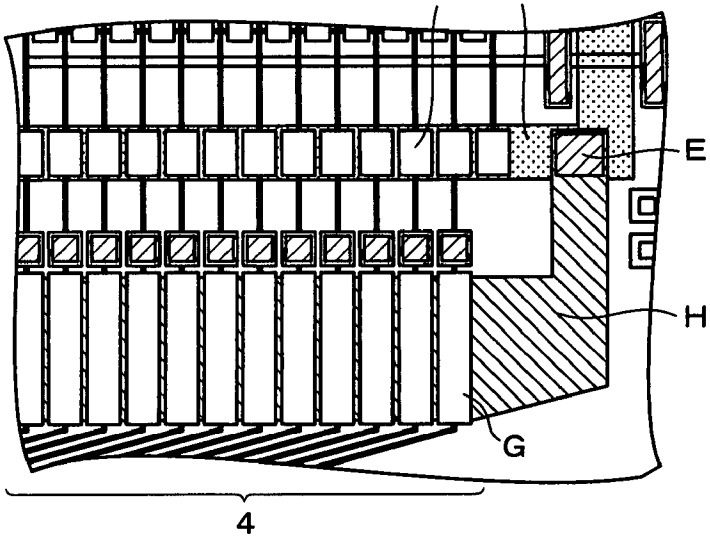
Figure 25:
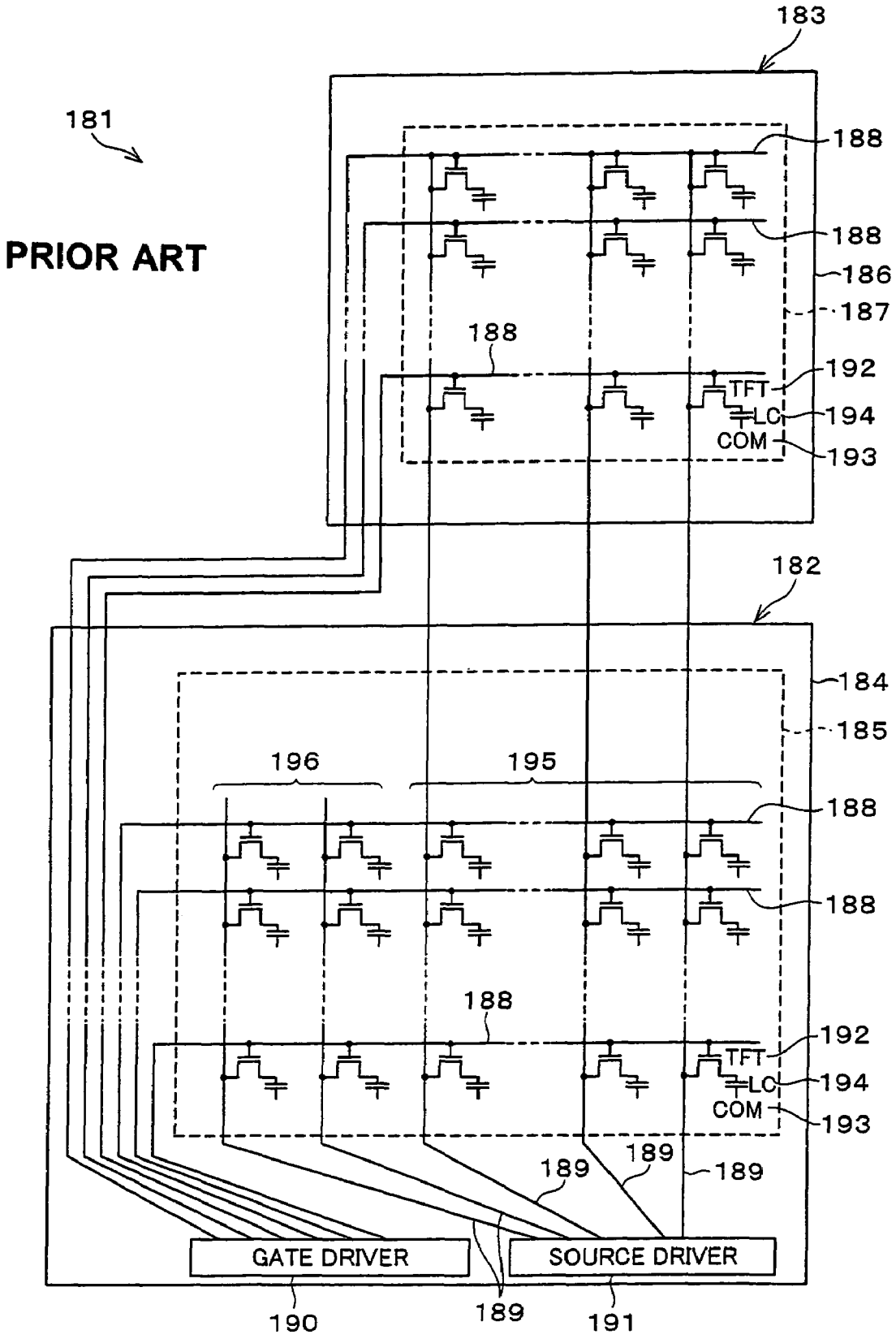
FIG. 25 is a circuit diagram showing an arrangement of a conventional display.

Now, the structure of the capacitances 6*a*, 6*b* on the main panel 2 will be describe in more detail with reference to FIGS. 24(*a*)-24(*c*). FIG. 24(*a*) is a schematic more specifically showing the main panel 2, in particular, the structure of an end thereof opposite a gate driver across the display area (i.e., the end connected to the sub-panel 3 through, for example, an FPC). FIG. 24(*b*) is a magnified view of portion B in FIG. 24(*a*), and FIG. 24(*c*) is a magnified view of portion C in FIG. 24(*a*).

The source bus lines 5 in FIG. 24(*b*) are connected to the sub-panel 3 (not shown), whereas the source bus lines 4 in FIGS. 24(*b*), 24(*c*) are not. Since the capacitance of the source bus line 5, connected to the sub-panel 3, is greater than that of the source bus line 4, the source bus line 4 is provided with supplemental capacitance. Member D in FIGS. 24(*b*), 24(*c*) is the Cs/common signal line 9' made of gate line material.

In the main panel 2 having such a structure, the capacitances 6*a*, 6*b* are formed by the added width of the existent source bus line 4 at its intersection with the Cs/common signal line 9' which is also existent, as indicated by F in FIG. 24(*c*). Also, the capacitances 6*a*, 6*b* are formed by the provision of new supplemental capacitance lines (identified as H in FIG. 24(*c*)) which branch off the Cs/common signal lines 9' and cross the source bus lines 4, as identified as G in FIG. 24(*c*). In FIG. 24(*c*), E represents a contact between the Cs/common signal line 9' (identified as D in FIG. 24(*c*)) and the supplemental capacitance line H.

In the main panel 2, the Cs/common signal lines 9' are made of gate line material, whereas the supplemental capacitance lines 9' branching off the Cs/common signal lines 9' are made of other, source line material. The change in material enables adjustment of the values of the supplemental capacitances without altering the gate line pattern. Alternatively, the capacitances may be formed by fabricating the source bus lines 4 of source line material and the supplemental capacitance lines 9' of the same gate line material as the Cs/common signal lines 9'.

Note that FIGS. 1, 2 omits some of the source bus lines 4, 5 and gate bus lines for convenience. An actual display has many source bus lines and gate bus lines as shown in FIG. 24(*a*).

Apart from the provision of the supplemental capacitance lines connected to the Cs/common signal lines 9' as in FIG. 2, the supplemental capacitance lines may be provided by, as examples, following methods.

Figure 3:
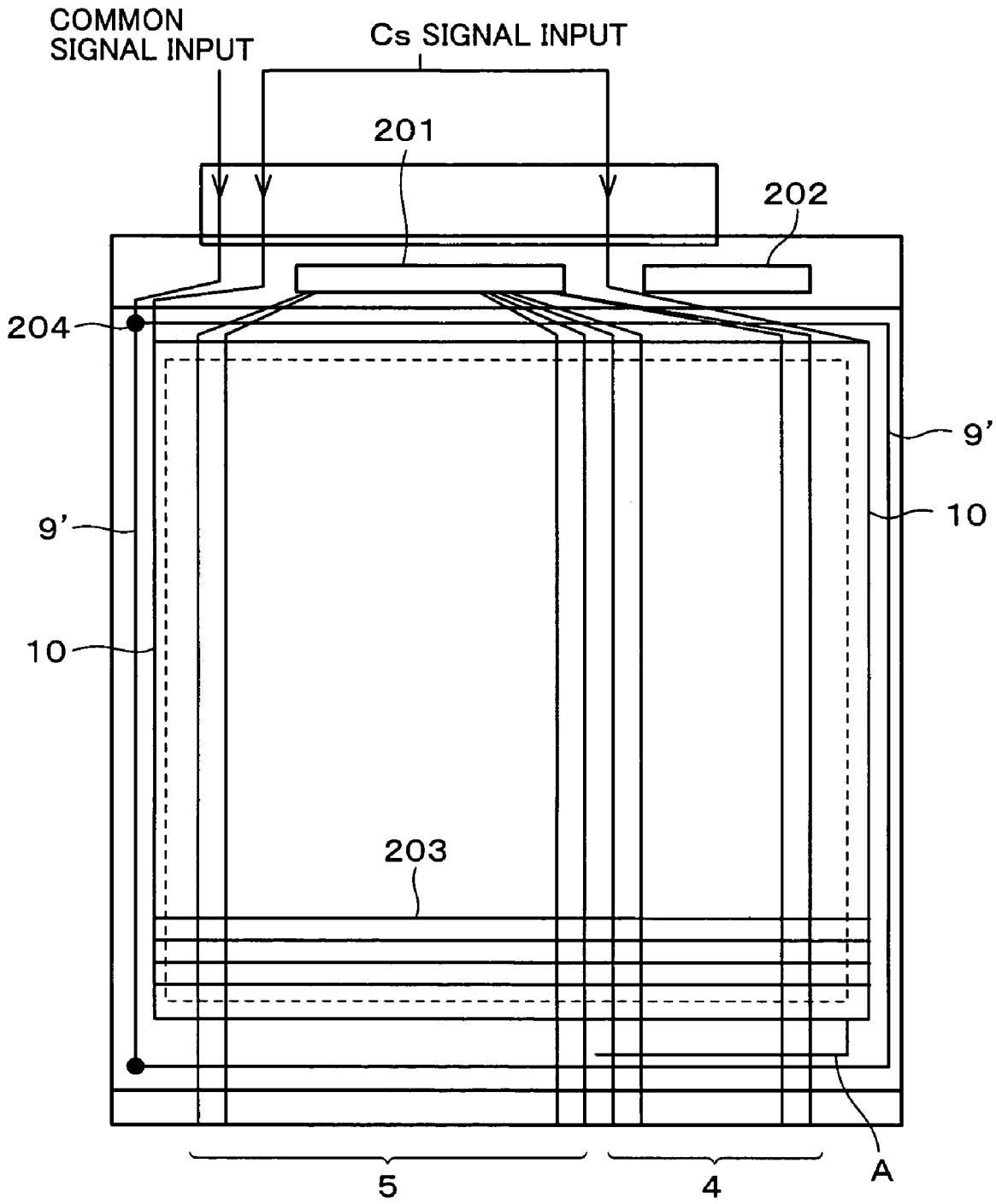
FIG. 3 is a schematic showing a main panel of a display, as an example of a display according to the present invention, in which lines providing supplemental capacitance are laid out by a different method from that used for the display in FIG. 2.
Figure 4:
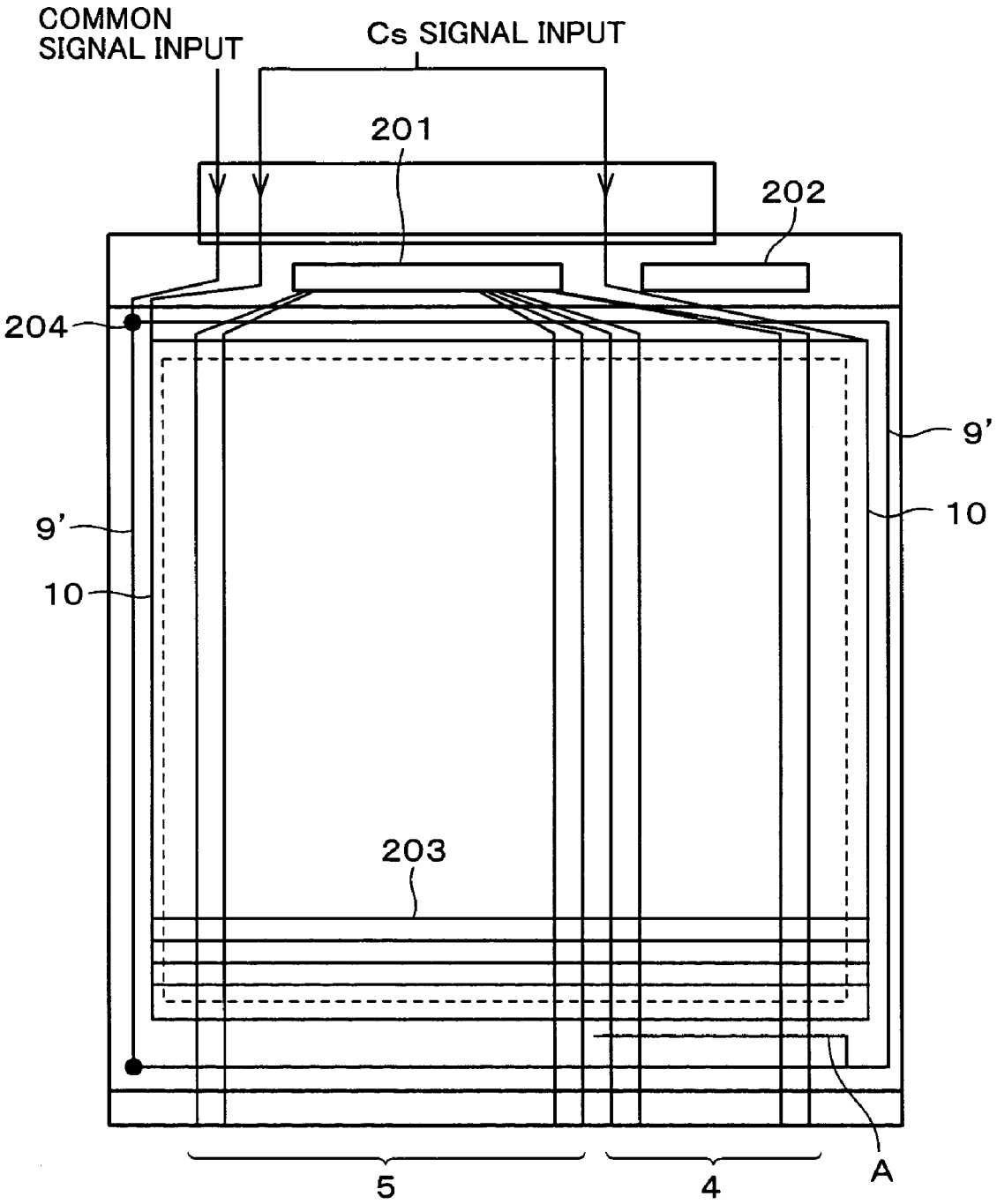
FIG. 4 is a schematic showing a main panel of a display, as an example of a display according to the present invention, in which lines providing supplemental capacitance are laid out by a different method from that used for the display in FIG. 2.
Figure 5:
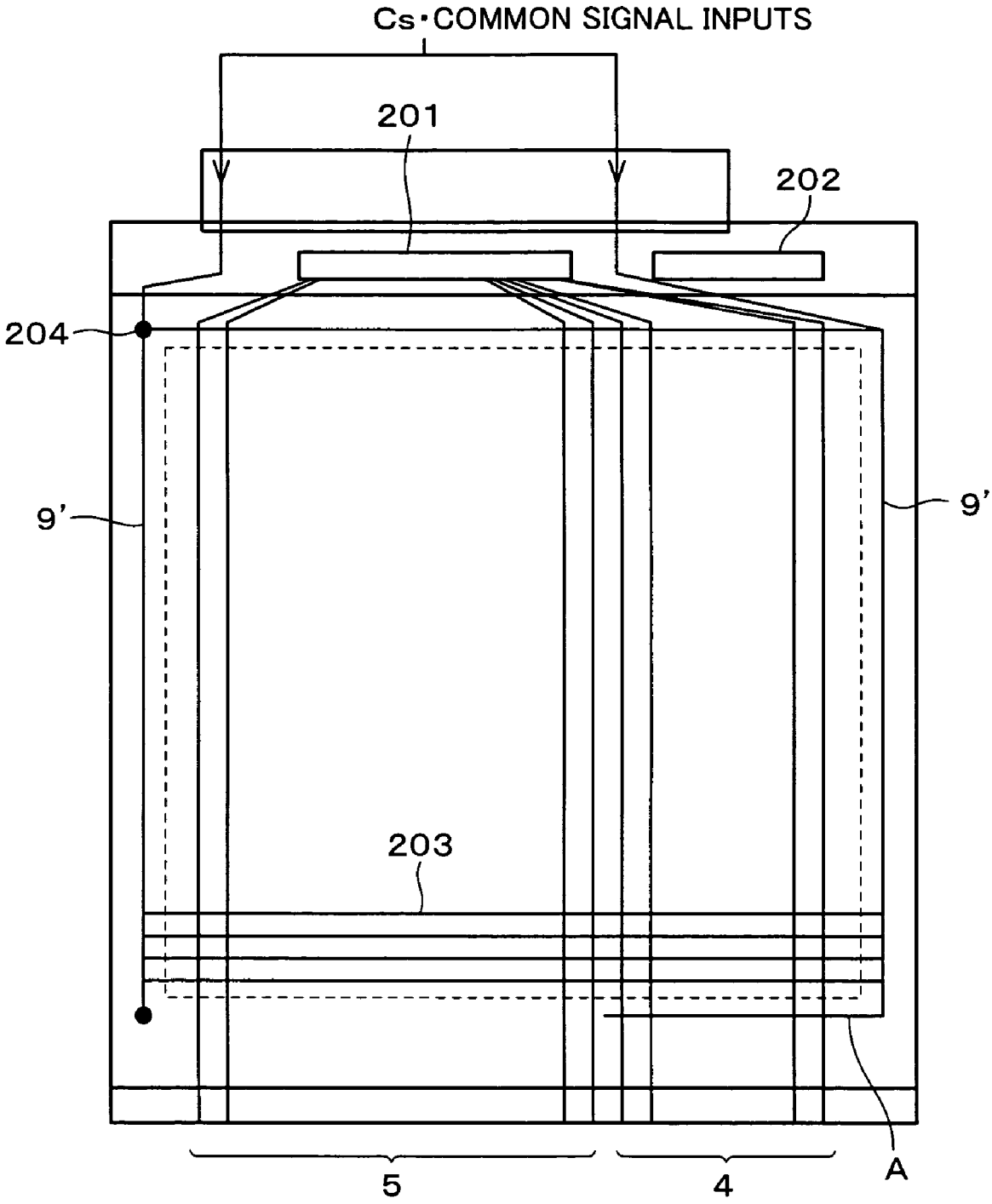
FIG. 5 is a schematic showing a main panel of a display, as an example of a display according to the present invention, in which lines providing supplemental capacitance are laid out by a different method from that used for the display in FIG. 2.
Figure 6:
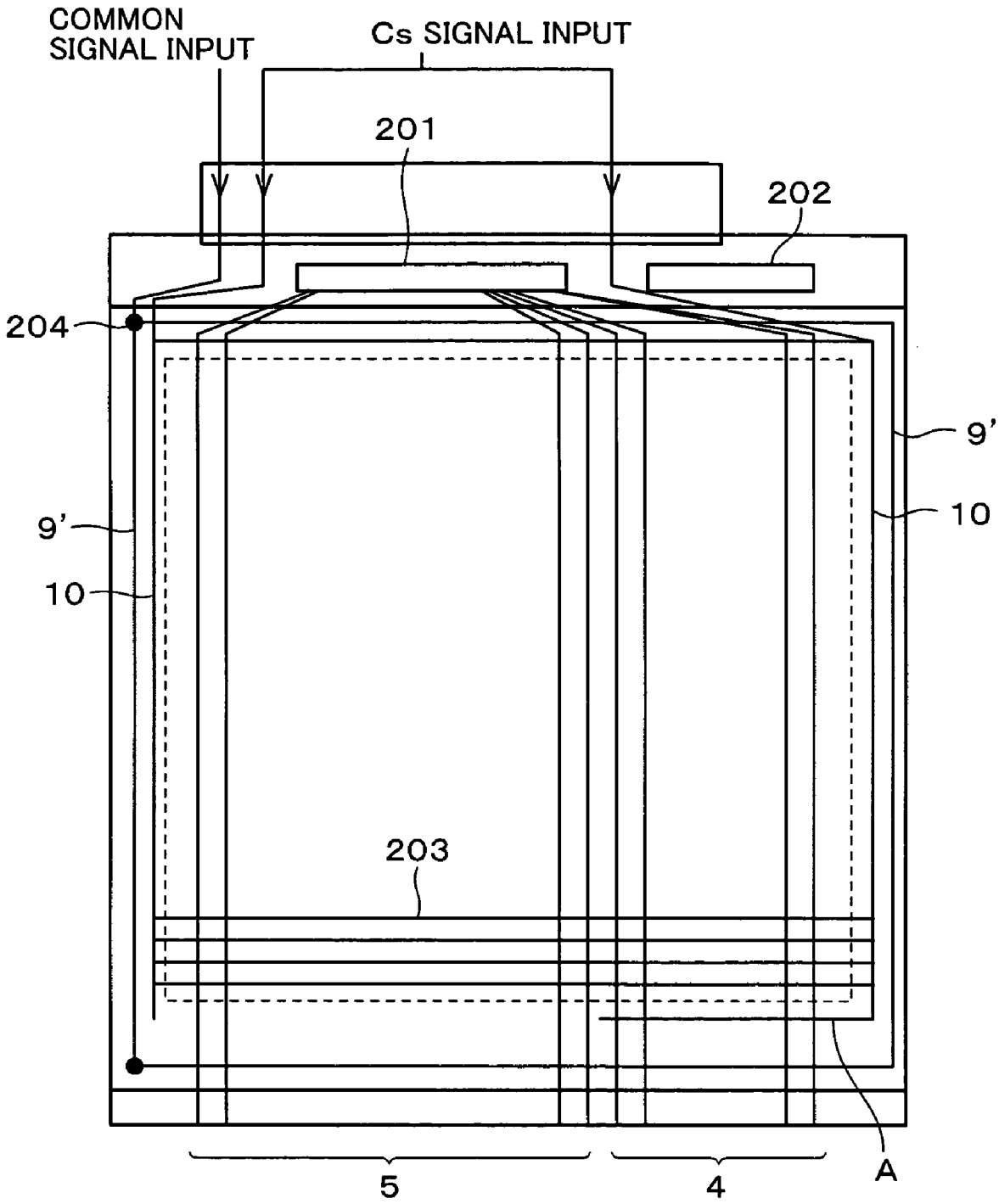
FIG. 6 is a schematic showing a main panel of a display, as an example of a display according to the present invention, in which lines providing supplemental capacitance are laid out by a different method from that used for the display in FIG. 2.
Figure 7:
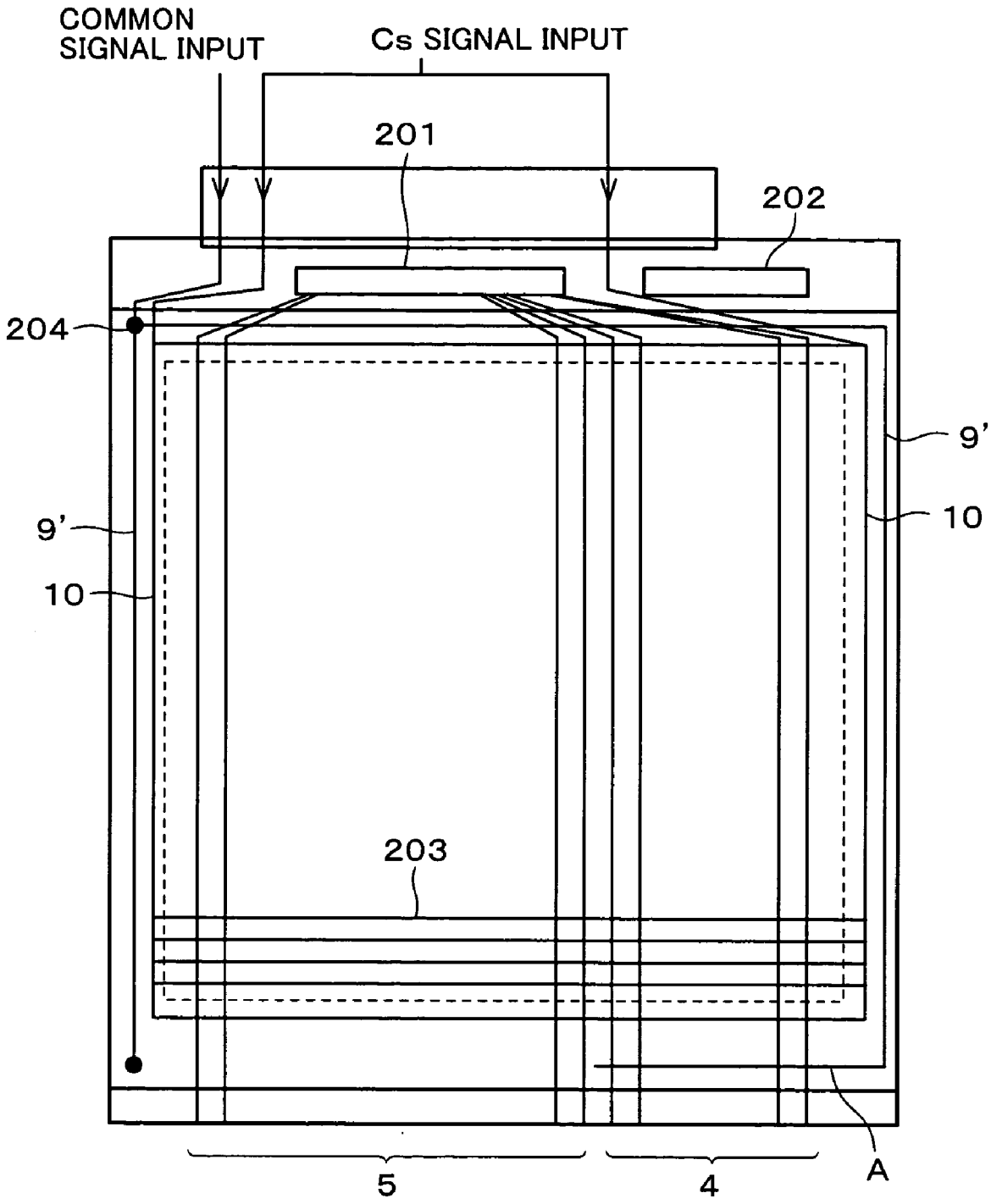
FIG. 7 is a schematic showing a main panel of a display, as an example of a display according to the present invention, in which lines providing supplemental capacitance are laid out by a different method from that used for the display in FIG. 2.
Figure 8:
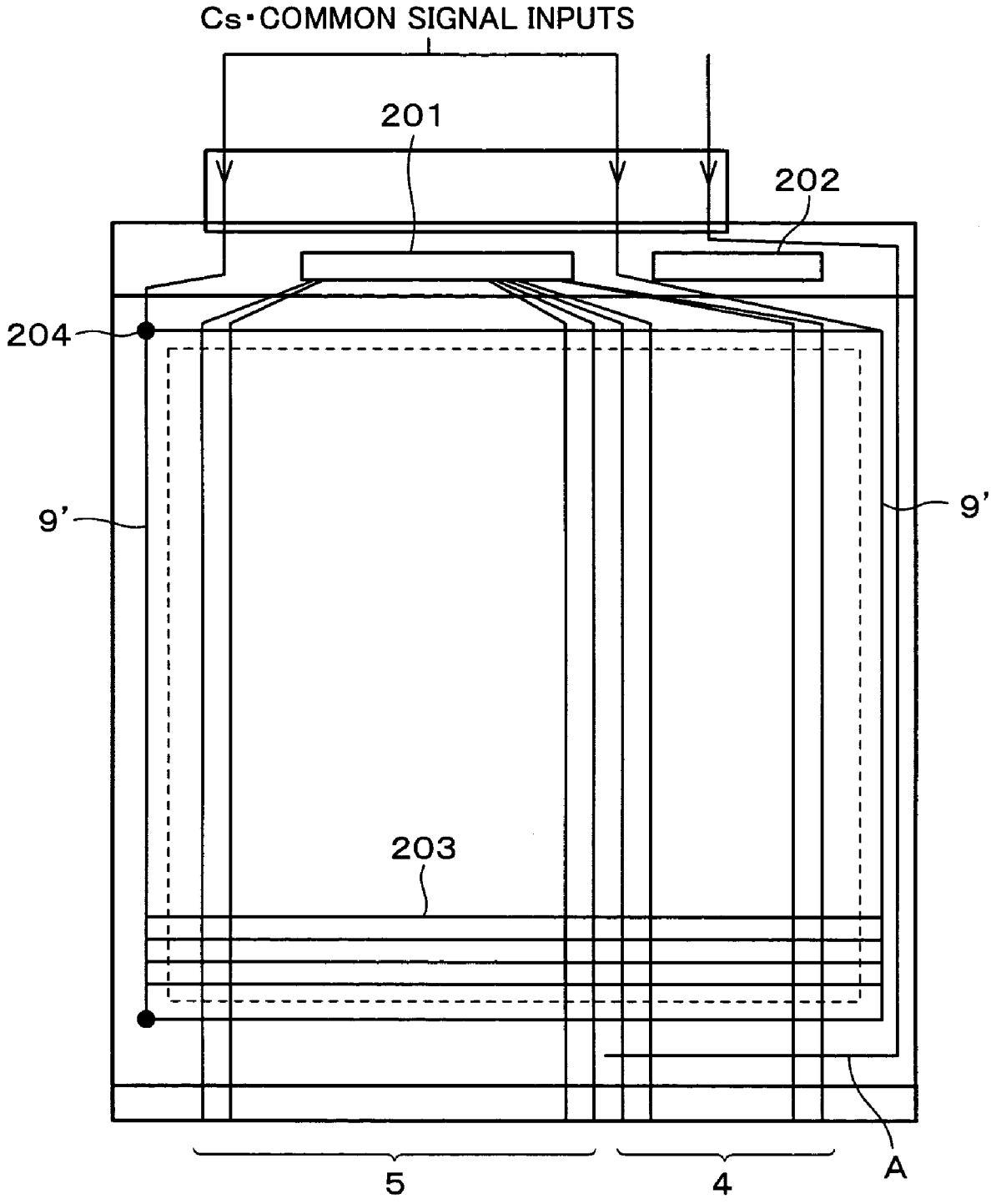
FIG. 8 is a schematic showing a main panel of a display, as an example of a display according to the present invention, in which lines providing supplemental capacitance are laid out by a different method from that used for the display in FIG. 2.

A first method, as shown in FIG. 3, is to provide supplemental capacitance lines A connected to the Cs signal lines 10. A second method, as shown in FIG. 4, is to provide supplemental capacitance lines A connected to the common signal lines 9'. A third method, as shown in FIG. 5, is to cut off parts of the Cs/common signal lines 9' so that they can behave as supplemental capacitance lines A. A fourth method, as shown in FIG. 6, is to cut off parts of the Cs signal lines 10 so that they can behave as supplemental capacitance lines A. A fifth method, as shown in FIG. 7, is to cut off parts of the common signal lines 9' so that they can behave as supplemental capacitance lines A. A sixth method, as shown in FIG. 8, is to provide independent signal lines A dedicated for supplemental capacitance. A further method (not shown in any of the figures) is to, for example, form supplemental capacitance by arranging source bus lines so that they cross signal lines for dummy pixels (pixels in non-display areas) or inspection lines other than Cs signal lines or common signal lines.

The third method is employed when there are provided lines acting as both the Cs signal lines and the common signal lines. The first to fifth, except the third, are employed when the Cs signal lines and the common signal lines are provided separately. The sixth method is employed whether there are provided lines acting as both the Cs signal lines and the common signal lines or the two groups of lines are provided separately. The Cs signal lines and the common signal lines are preferably arranged to enclose the display area to avoid static electricity buildup and signal delays; the lines may be however cut off as in the third to fifth methods.

The formation of the supplemental capacitance by one of the above methods can either eliminate or reduce the difference in capacitance between the source bus lines, effecting a good display both on the main panel and on the sub-panel.

Embodiment 2

Figure 9:
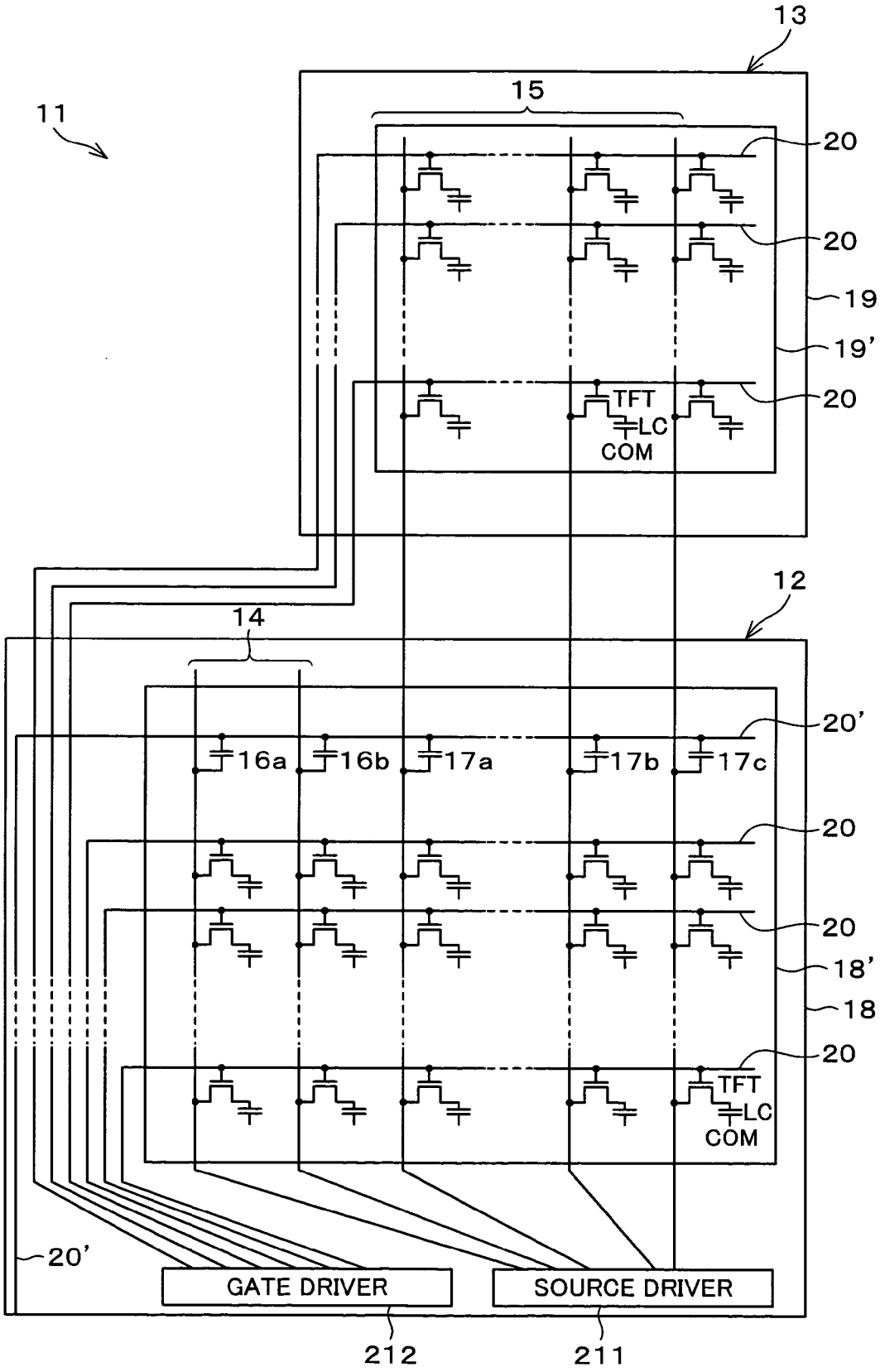
FIG. 9 is a circuit diagram showing an arrangement of a display of embodiment 2 according to the present invention.

Next, embodiment 2 of the present invention will be discussed. FIG. 9 is a circuit diagram showing an arrangement of a display 11 of present embodiment 2.

Referring to FIG. 9, the display 11 according to embodiment 2 is a twin panel type as is the display 1 according to embodiment 1 and includes a main panel (display panel) 12 and a sub-panel (display panel) 13. On the main panel 12 and the sub-panel 13 are there provided source bus lines (first bus lines) 14, 15 and gate bus lines (second bus lines) 20 in a matrix. The source bus lines (first bus lines) 15 on the main panel 12 are connected to the source bus lines 15 on the sub-panel 13 through, for example, an FPC (not shown). The other group of source bus lines (first bus lines) 14 are disposed only on the main panel 12. The source bus lines 14 have supplemental capacitances (first capacitances) 16*a*, 16*b* near the respective intersections with the common signal lines 20'. The source bus lines 15 have supplemental capacitances (second capacitances) 17*a*, 17*b*, 17*c* near the respective intersections with the common signal lines 20'. The display 11 in embodiment 2 has the same arrangement as the display 1 in embodiment 1, except how the supplemental capacitances are formed.

Similarly to the case of the display 1, in the display 11, the source bus lines 14 disposed only on the main panel 12 differ in capacitance from the source bus lines 15 disposed on both the main panel 12 and the sub-panel 13. Accordingly, to eliminate or reduce the difference in capacitance sufficiently so that it does not affect the display, the capacitances 16*a*, 16*b* for the source bus lines 14 are greater than the capacitances 17*a*, 17*b*, 17*c* for the source bus lines 15. In other words, it is preferable if the values of the capacitances 16*a*, 16*b*, 17*a*, 17*b*, 17*c* are set so as to eliminate or sufficiently reduce the capacitance difference between the source bus lines 14 and the source bus lines 15. The settings allow for no difference between the signal delay on the source bus lines 14 and that on the source bus lines 15, preventing display defects and other inconveniences from occurring due to signal delay difference.

The values of the capacitances 16*a*, 16*b* may be exactly equal to each other or have such small difference that it does not affect the display. The capacitances 17*a*, 17*b*, 17*c* may be exactly equal to one another or have such small difference that it does not affect the display. The capacitances may be formed by, for example, arranging the source bus lines 14, 15 and the common signal lines 19' to cross separated by, for example, an insulating film intervening there between, or by any other method including those discussed in embodiment 1.

Embodiment 3

Figure 10:
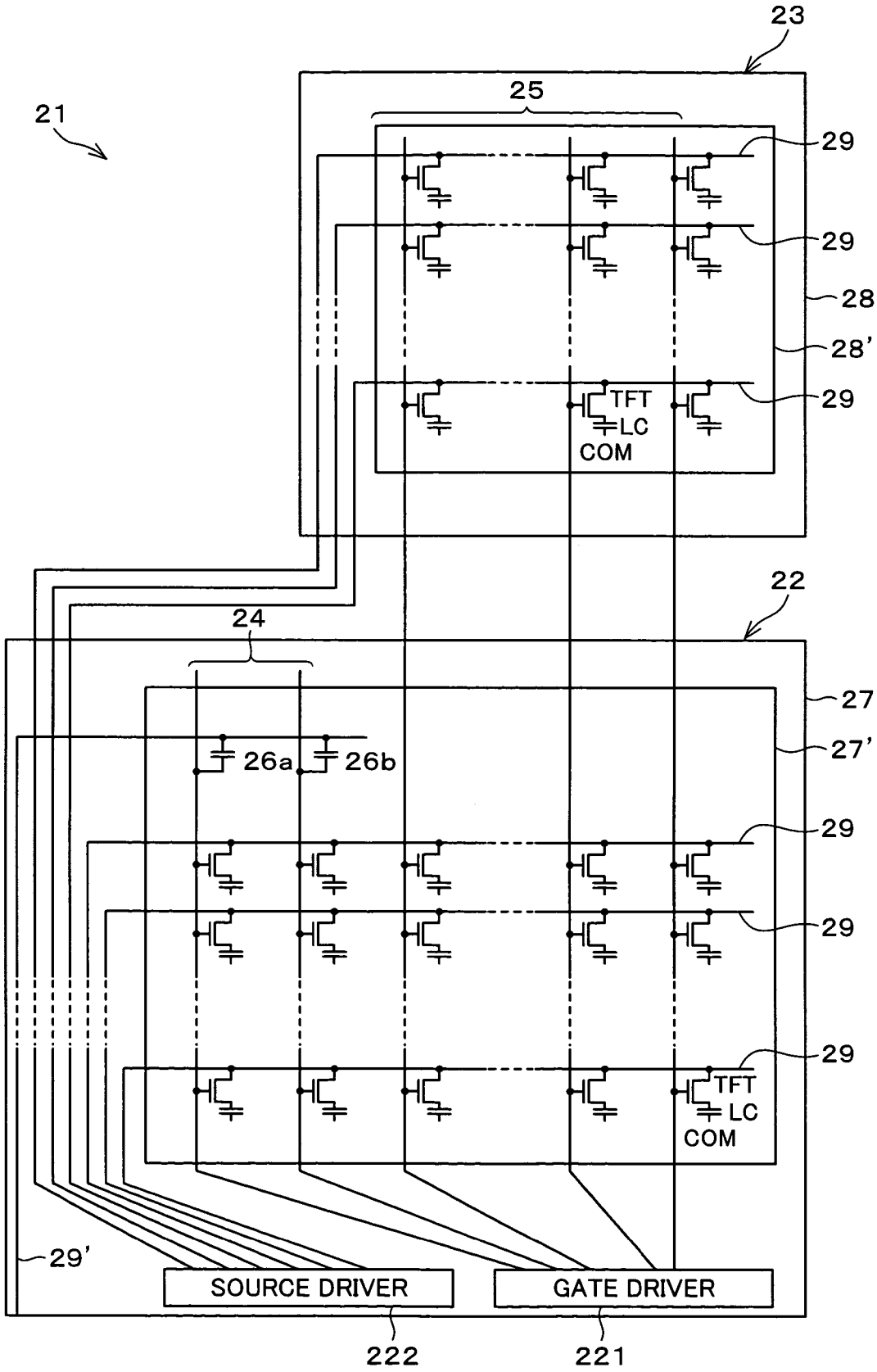
FIG. 10 is a circuit diagram showing an arrangement of a display of embodiment 3 according to the present invention.

Now, embodiment 3 of the present invention will be discussed. FIG. 10 is a circuit diagram showing an arrangement of a display 21 of present embodiment 3.

Referring to FIG. 10, the display 21 according to embodiment 3 is of a twin panel type as is the display 1 according to embodiment 1 and includes a main panel (display panel) 22 and a sub-panel (display panel) 23. On the main panel 22 and the sub-panel 23 are there provided gate bus lines (first bus lines) 24, 25 and source bus lines (second bus lines) 29 in a matrix. The gate bus lines (first bus lines) 25 on the main panel 22 are connected to the gate bus lines 25 on the sub-panel 23 through, for example, an FPC (not shown). The other group of gate bus lines (first bus lines) 24 are disposed only on the main panel 22. The gate bus lines 24 have supplemental capacitances (first capacitances) 26*a*, 26*b* near the respective intersections with the common signal lines 29'. The position of the gate driver 221 and the source driver 222 in the display 21 of embodiment 3 is reversed when compared to that in the display 1 of embodiment 1; accordingly, the position of the gate bus lines 24, 25 and the source bus lines 29 is also reversed when compared to that in the display 1.

In the display 21, the gate bus lines 24 disposed only on the main panel 22 differ in capacitance from the gate bus lines 25 disposed on both the main panel 22 and the sub-panel 23. The gate bus lines 25 are therefore capacitance loaded by the sub-panel 23, as well as by the main panel 22, upon driving the main panel 22. On the other hand, the gate bus lines 24 are capacitance loaded only by the main panel 22 upon driving the main panel 22.

To eliminate or reduce the difference in capacitance sufficiently so that it does not affect the display, the supplemental capacitances 26*a*, 26*b* are formed on the gate bus lines 24 disposed only on the TFT substrate 27 for the main panel 22. The formation allows for no difference between the signal delay on the gate bus lines 24 and the signal delay on the gate bus lines 25, preventing display defects and other inconveniences from occurring due to signal delay difference.

The values of the capacitances 26*a*, 26*b* may be exactly equal to each other or have such small difference that it does not affect the display. The capacitances may be formed by, for example, arranging the gate bus lines 24, 25 and the common signal lines 29' to cross separated by, for example, an insulating film intervening there between, or by any other method including those discussed in embodiment 1.

Embodiment 4

Figure 11:
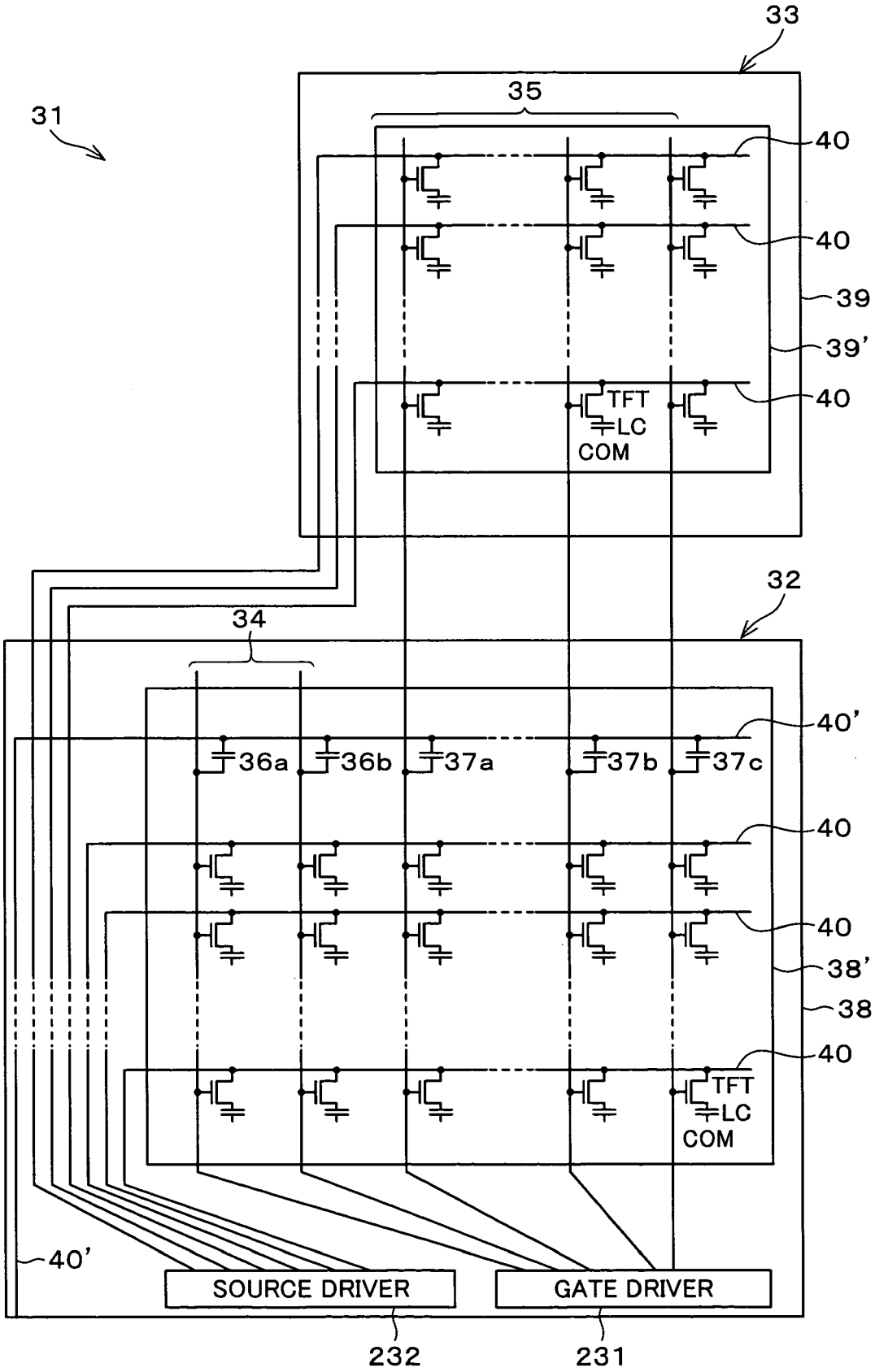
FIG. 11 is a circuit diagram showing an arrangement of a display of embodiment 4 according to the present invention.

Embodiment 4 of the present invention will be now discussed. FIG. 11 is a circuit diagram showing an arrangement of a display 31 of present embodiment 4.

Referring to FIG. 11, the display 31 according to embodiment 4 is of a twin panel type as is the display 1 according to embodiment 1 and includes a main panel (display panel) 32 and a sub-panel (display panel) 33. On the main panel 32 and the sub-panel 33 are there provided gate bus lines (first bus lines) 34, 35 and source bus lines (second bus lines) 40 in a matrix. The gate bus lines (first bus lines) 35 on the main panel 32 are connected to the gate bus lines 35 on the sub-panel 33 through, for example, an FPC (not shown). The other group of gate bus lines (first bus lines) 34 are disposed only on the main panel 32. The gate bus lines 34 have supplemental capacitances (first capacitances) 36*a*, 36*b* near the respective intersections with the common signal lines 40'. The gate bus lines 35 have supplemental capacitances (second capacitances) 37*a*, 37*b*, 37*c* near the respective intersections with the common signal lines 40'. The display 31 in embodiment 3 has the same arrangement as the display 21 in embodiment 3, except how the supplemental capacitances are formed.

Similarly to the aforementioned embodiment, in the display 31, the gate bus lines 34 disposed only on the main panel 32 differ in capacitance from the gate bus lines 35 disposed on both the main panel 32 and the sub-panel 33. Accordingly, to eliminate or reduce the difference in capacitance sufficiently so that it does not affect the display, the capacitances 36*a*, 36*b* for the gate bus lines 34 are greater than the capacitances 37*a*, 37*b*, 37*c* for the gate bus lines 35. In other words, it is preferable if the values of the capacitances 36*a*, 36*b*, as well as 37*a*, 37*b*, 37*c*, are set so as to eliminate or sufficiently reduce the capacitance difference between the gate bus lines 34 and the gate bus lines 35. The settings allow for no difference between the signal delay on the gate bus lines 34 and the signal delay on the gate bus lines 35, preventing display defects and other inconveniences from occurring due to signal delay difference.

The values of the capacitances 36*a*, 36*b* may be exactly equal to each other or have such small difference that it does not affect the display. The values of the capacitances 37*a*, 37*b*, 37*c* may be exactly equal to one another or have such small difference that it does not affect the display. The capacitances may be formed by, for example, arranging the gate bus lines 34, 35 and the common signal lines 40' to cross separated by, for example, an insulating film intervening there between, or by any other method including those discussed in embodiment 1.

Embodiment 5

Figure 12:
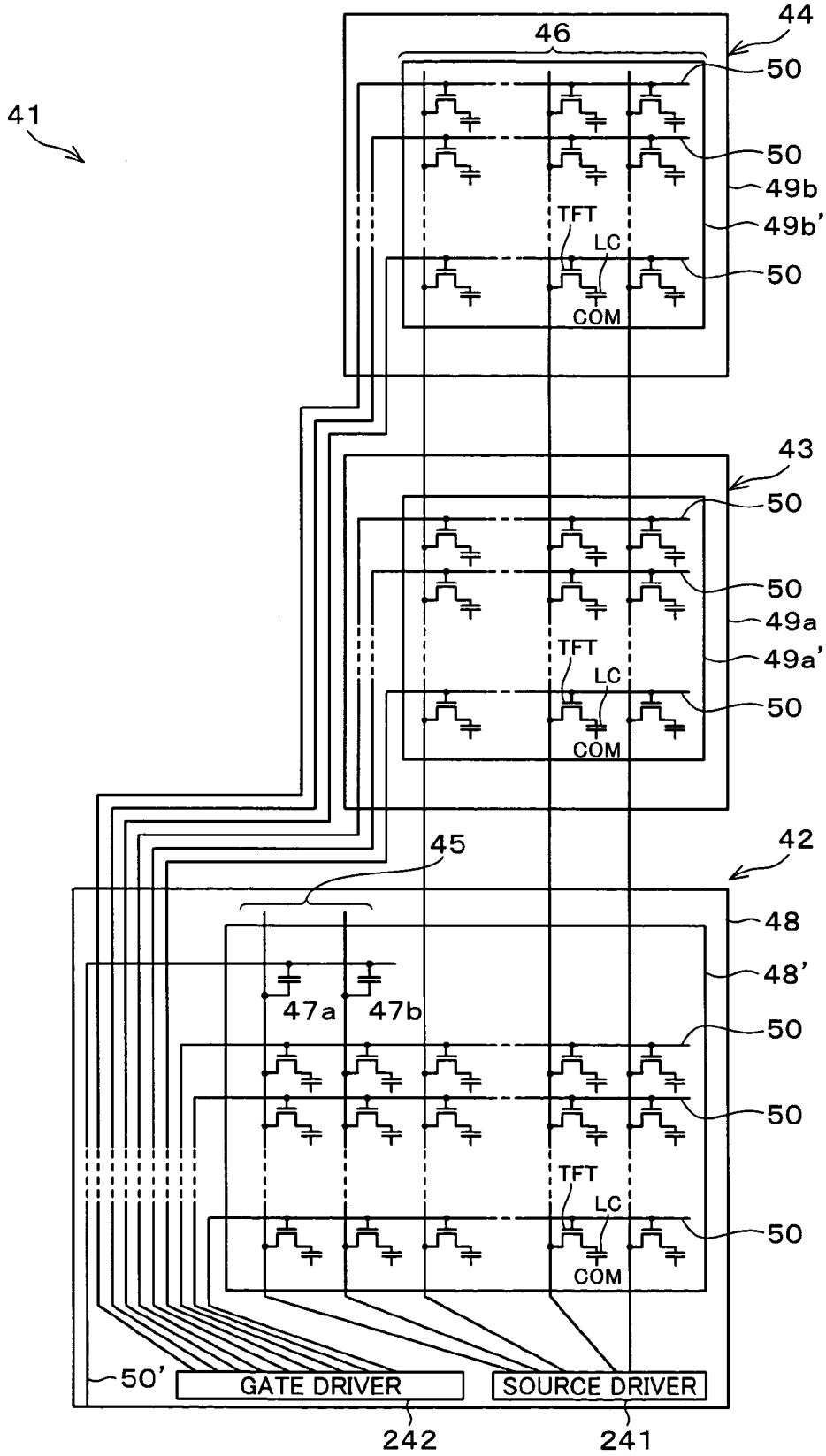
FIG. 12 is a circuit diagram showing an arrangement of a display of embodiment 5 according to the present invention.

Embodiment 5 of the present invention will be now discussed. FIG. 12 is a circuit diagram showing an arrangement of a display 41 of present embodiment 5.

The display 41 according to the present embodiment includes three display panels: a main panel which is the main display screen and two sub-panels with less display pixels than the main panel. This feature of the display 41 of embodiment 5 is specifically shown in FIG. 12 as the main panel (display panel) 42 and two sub-panels (display panels) 43, 44. On the main panel 42 and the sub-panels 43, 44 are there provided source bus lines (first bus lines) 45, 46 and gate bus lines (second bus lines) 50 in a matrix. The source bus lines (first bus lines) 46 on the main panel 42 are connected to the source bus lines 46 on the sub-panels 43, 44 through, for example, an FPC (not shown). The other group of source bus lines (first bus lines) 45 are disposed only on the main panel 42. The source bus lines 45 have supplemental capacitances (first capacitances) 47*a*, 47*b* near the respective intersections with the common signal lines 50'. The display 41 in embodiment 5 has the same arrangement as the display 1 in embodiment 1, except that the display 41 has two sub-panels.

Similarly to the aforementioned embodiment, in the display 41, the source bus lines 45 disposed only on the main panel 42 differ in capacitance from the source bus lines 46 disposed on both the main panel 42 and the sub-panels 43, 44. The source bus lines 46 are therefore capacitance loaded by the sub-panels 43, 44, as well as by the main panel 42, upon driving the main panel 42. On the other hand, the source bus lines 45 are capacitance loaded only by the main panel 42 upon driving the main panel 42.

To eliminate or reduce the difference in capacitance sufficiently so that it does not affect the display, the supplemental capacitances 47*a*, 47*b* are formed for the source bus lines 45 disposed only on the TFT substrate 48 for the main panel 42. The formation allows for no difference between the signal delay on the source bus lines 45 and the signal delay on the source bus lines 46, preventing display defects other inconveniences from occurring due to signal delay difference. The values of the capacitances 47*a*, 47*b* may be exactly equal to each other or have such small difference that it does not affect the display. The capacitances may be formed by, for example, arranging the source bus lines 45 and the common signal lines 50' to cross separated by, for example, an insulating film intervening there between, or by any other method including those discussed in embodiment 1.

Embodiment 6

Figure 13:
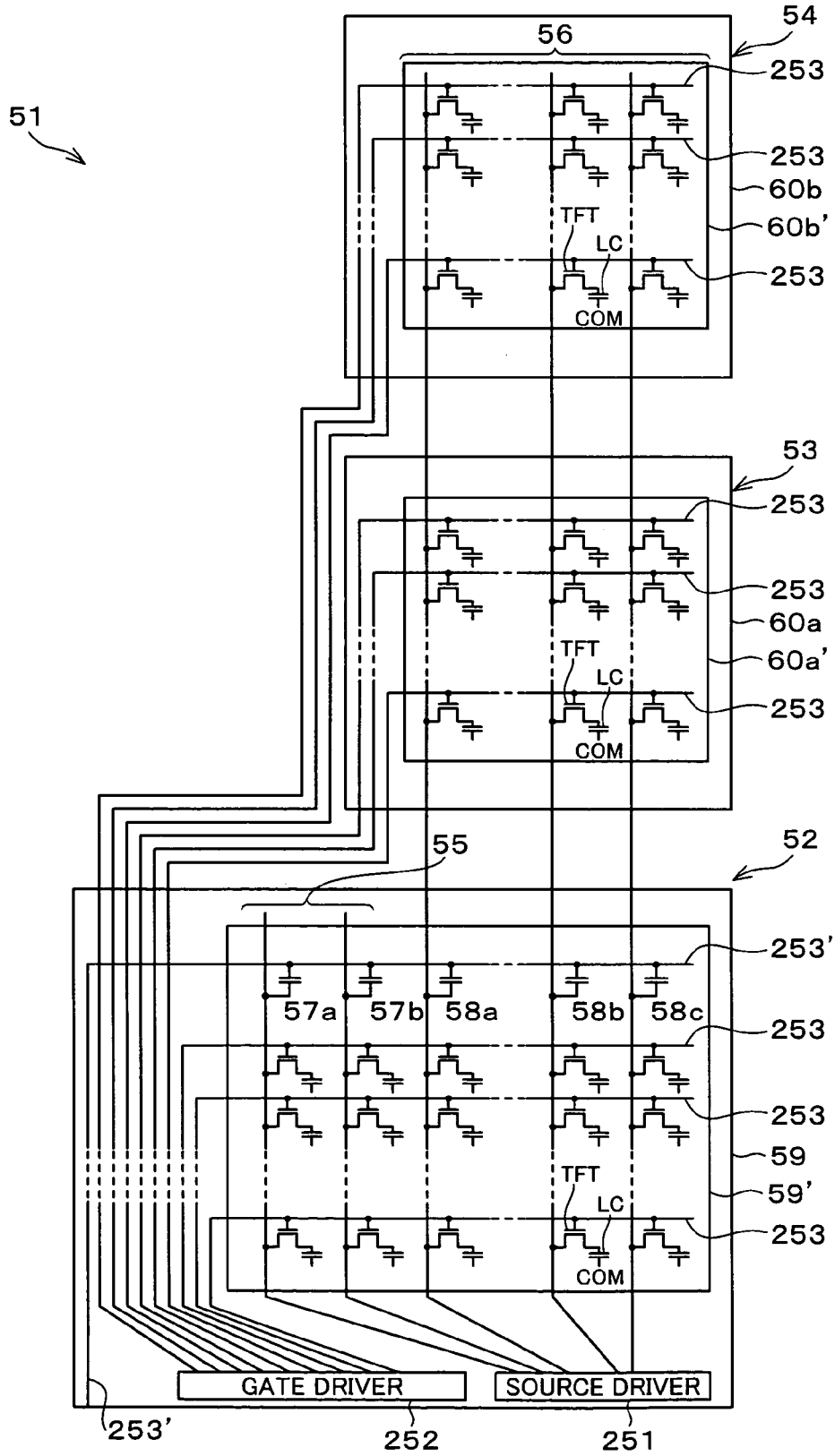
FIG. 13 is a circuit diagram showing an arrangement of a display of embodiment 6 according to the present invention.

Embodiment 6 of the present invention will be now discussed. FIG. 13 is a circuit diagram showing an arrangement of a display 51 of present embodiment 6.

As shown in FIG. 13, similarly to the display 41 according to embodiment 5, the display 51 according to embodiment 6 includes a main panel (display panel) 52 and two sub-panels (display panel) 53, 54. On the main panel 52 and the sub-panels 53, 54 are there provided source bus lines (first bus lines) 55, 56 and gate bus lines (second bus lines) 253 in a matrix. The source bus lines (first bus lines) 56 on the main panel 52 are connected to the source bus lines 56 on the sub-panels 53, 54 through, for example, an FPC (not shown). The other group of source bus lines (first bus lines) 55 are disposed only on the main panel 52. The source bus lines 55 have supplemental capacitances (first capacitances) 57*a*, 57*b* near the respective intersections with the common signal lines 253'. The source bus lines 56 have supplemental capacitances (second capacitances) 58*a*, 58*b*, 58*c* near the respective intersections with the common signal lines 253'. The display 51 in embodiment 6 has the same arrangement as the display 41 in embodiment 5, except how the supplemental capacitances are formed.

Similarly to the aforementioned embodiment, in the display 51, the source bus lines 55 disposed only on the main panel 52 differ in capacitance from the source bus lines 56 disposed on both the main panel 52 and the sub-panels 53, 54. Accordingly, to eliminate or reduce the difference in capacitance sufficiently so that it does not affect the display, the capacitances 57*a*, 57*b* for the source bus lines 55 greater than the capacitances 58*a*, 58*b*, 58*c* for the source bus lines 56. In other words, it is preferable if the values of the capacitances 57*a*, 57*b*, as well as 58*a*, 58*b*, 58*c*, are set so as to eliminate or sufficiently reduce the capacitance difference between the source bus lines 55 and the source bus lines 56. The settings allow for no difference between the signal delay on the source bus lines 55 and the signal delay on the source bus lines 56, preventing display defects and other inconveniences from occurring due to signal delay difference.

The values of the capacitances 57*a*, 57*b* may be exactly equal to each other or have such small difference that it does not affect the display. The values of the capacitances 58*a*, 58*b*, 58*c* may be exactly equal to each other or have such small difference that it does not affect the display. The capacitances may be formed by, for example, arranging the source bus lines 55, 56 and the common signal lines 253' to cross separated by, for example, an insulating film intervening there between, or by any other method including those discussed in embodiment 1.

Embodiment 7

Figure 14:
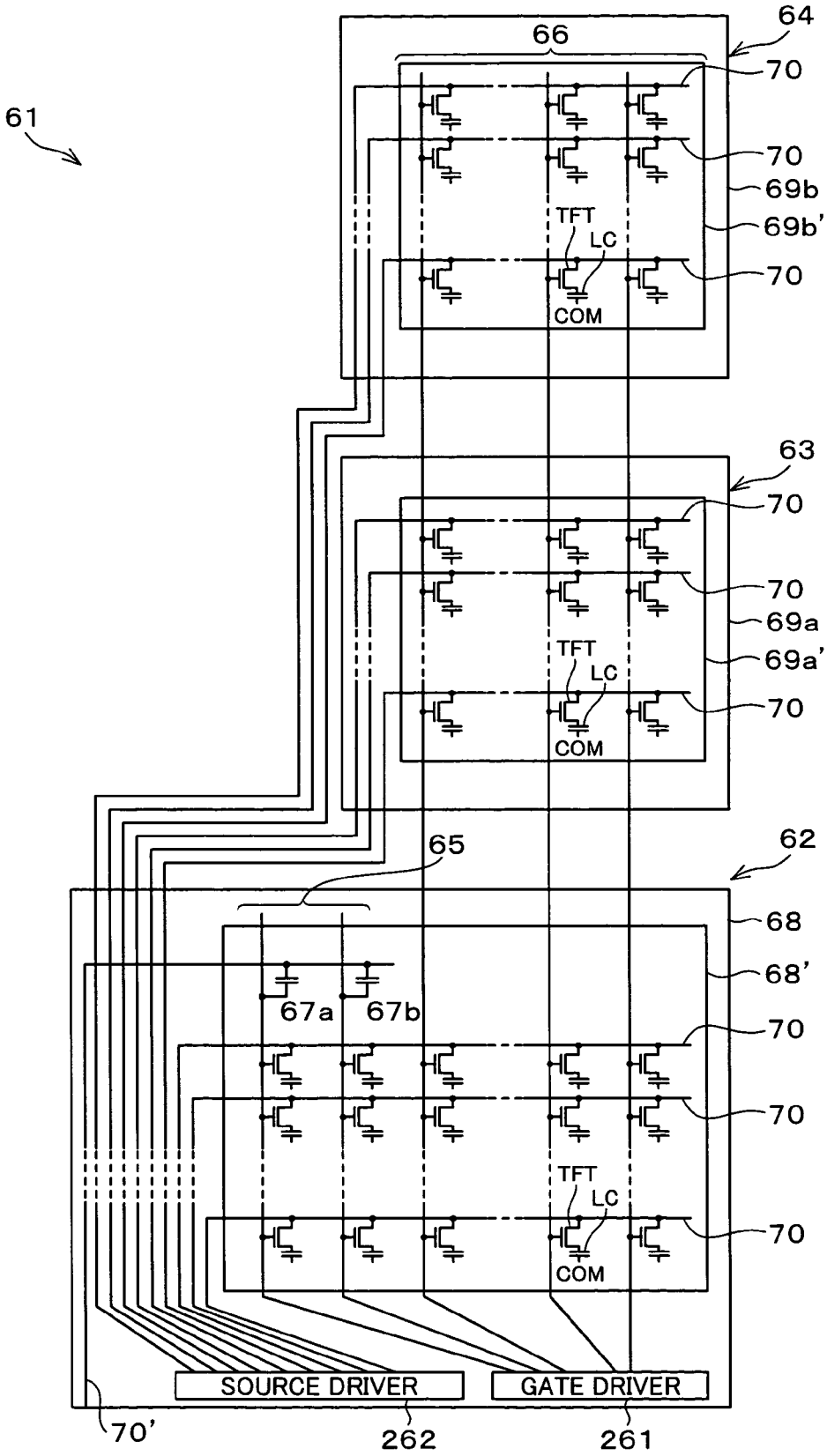
FIG. 14 is a circuit diagram showing an arrangement of a display of embodiment 7 according to the present invention.

Embodiment 7 of the present invention will be now discussed. FIG. 14 is a circuit diagram showing an arrangement of a display 61 of present embodiment 7.

As shown in FIG. 14, similarly to the display 41 according to embodiment 5, the display 61 according to embodiment 7 includes a main panel 62 (display panel) and two sub-panels (display panel) 63, 64. On the main panel 62 and the sub-panels 63, 64 are there provided gate bus lines (first bus lines) 65, 66 and source bus lines (second bus lines) 70 in a matrix. The gate bus lines (first bus lines) 66 on the main panel 62 are connected to the gate bus lines 66 on the sub-panels 63, 64 through, for example, an FPC (not shown). The other group of gate bus lines (first bus lines) 65 are disposed only on the main panel 62. The gate bus lines 65 have supplemental capacitances (first capacitances) 67*a*, 67*b* near the respective intersections with the common signal lines 70'. The position of the gate driver 261 and the source driver 262 in the display 61 of embodiment 7 is reversed when compared to that in the display 41 of embodiment 5; accordingly, the position of the gate bus lines 65, 66 and the source bus lines 70 is also reversed when compared to that in the display 41.

Similarly to the aforementioned embodiment, in the display 61, the gate bus lines 65 disposed only on the main panel 62 differ in capacitance from the gate bus lines 66 disposed on both the main panel 42 and the sub-panels 43, 44. The gate bus lines 66 are therefore capacitance loaded by the sub-panels 63, 64, as well as by the main panel 62, upon driving the main panel 62. On the other hand, the gate bus lines 65 are capacitance loaded only by the main panel 62 upon driving the main panel 62.

To eliminate or reduce the difference in capacitance sufficiently so that it does not affect the display, the supplemental capacitances 67*a*, 67*b* are formed for the gate bus lines 65 disposed only on the TFT substrate 68 for the main panel 62. The formation allows for no difference between the signal delay on the gate bus lines 65 and the signal delay on the gate bus lines 66, preventing display defects and other inconveniences from occurring due to signal delay difference.

The values of the capacitances 67*a*, 67*b* may be exactly equal to each other or have such small difference that it does not affect the display. The capacitances may be formed by, for example, arranging the gate bus lines 65 and the common signal lines 70' to cross separated by, for example, an insulating film intervening there between, or by any other method including those discussed in embodiment 1.

Embodiment 8

Figure 15:
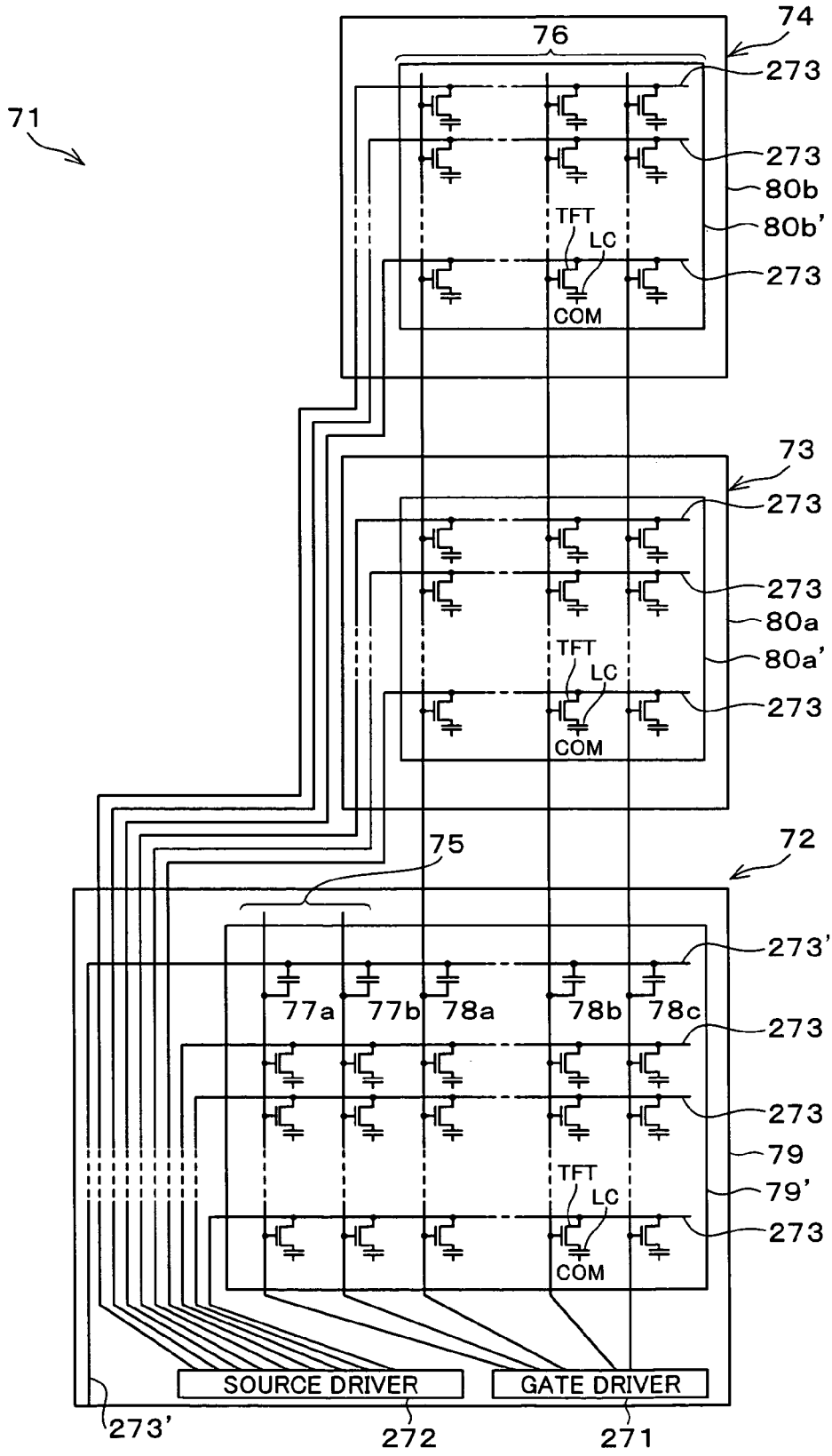
FIG. 15 is a circuit diagram showing an arrangement of a display of embodiment 8 according to the present invention.

Embodiment 8 of the present invention will be now discussed. FIG. 15 is a circuit diagram showing an arrangement of a display 71 of present embodiment 8.

As shown in FIG. 15, similarly to the display 41 according to embodiment 5, the display 71 according to embodiment 8 includes a main panel (display panel) 72 and two sub-panels (display panel) 73, 74. On the main panel 72 and the sub-panels 73, 74 are there provided gate bus lines (first bus lines) 75, 76 and source bus lines (second bus lines) 273 in a matrix. The gate bus lines (first bus lines) 76 on the main panel 72 are connected to the gate bus lines 76 on the sub-panels 73, 74 through, for example, an FPC (not shown). The other group of gate bus lines (first bus lines) 75 are disposed only on the main panel 72. The gate bus lines 75 have supplemental capacitances (first capacitances) 77*a*, 77*b* near the respective intersections with the common signal lines 273'. The gate bus lines 76 have supplemental capacitances (second capacitances) 78*a*, 78*b*, 78*c* near the respective intersections with the common signal lines 273'. The display 71 in embodiment 8 has the same arrangement as the display 61 in embodiment 7, except how the supplemental capacitances are formed.

Similarly to the aforementioned embodiment, in the display 71, the gate bus lines 75 disposed only on the main panel 72 differ in capacitance from the gate bus lines 76 disposed on both the main panel 72 and the sub-panels 73, 74. Accordingly, to eliminate or reduce the difference in capacitance sufficiently so that it does not affect the display, the capacitances 77*a*, 77*b* for the gate bus lines 75 are greater than the capacitances 78*a*, 78*b*, 78*c* for the gate bus lines 76. In other words, it is preferable if the values of the capacitances 77*a*, 77*b*, as well as 78*a*, 78*b*, 78*c*, are set so as to eliminate or sufficiently reduce the capacitance difference between the gate bus lines 75 and the gate bus lines 76. The settings allow for no difference between the signal delay on the gate bus lines 75 and the signal delay on the gate bus lines 76, preventing display defects and other inconveniences from occurring due to signal delay difference.

The values of the capacitances 77*a*, 77*b* may be exactly equal to each other or have such small difference that it does not affect the display. The values of the capacitances 78*a*, 78*b*, 78*c* may be exactly equal to one another or have such small difference that it does not affect the display. The capacitances may be formed by, for example, arranging the gate bus lines 75, 76 and the common signal lines 273' to cross separated by, for example, an insulating film intervening there between, or by any other method including those discussed in embodiment 1.

Embodiment 9

Embodiment 9 of the present invention will be now discussed.

Figure 16:
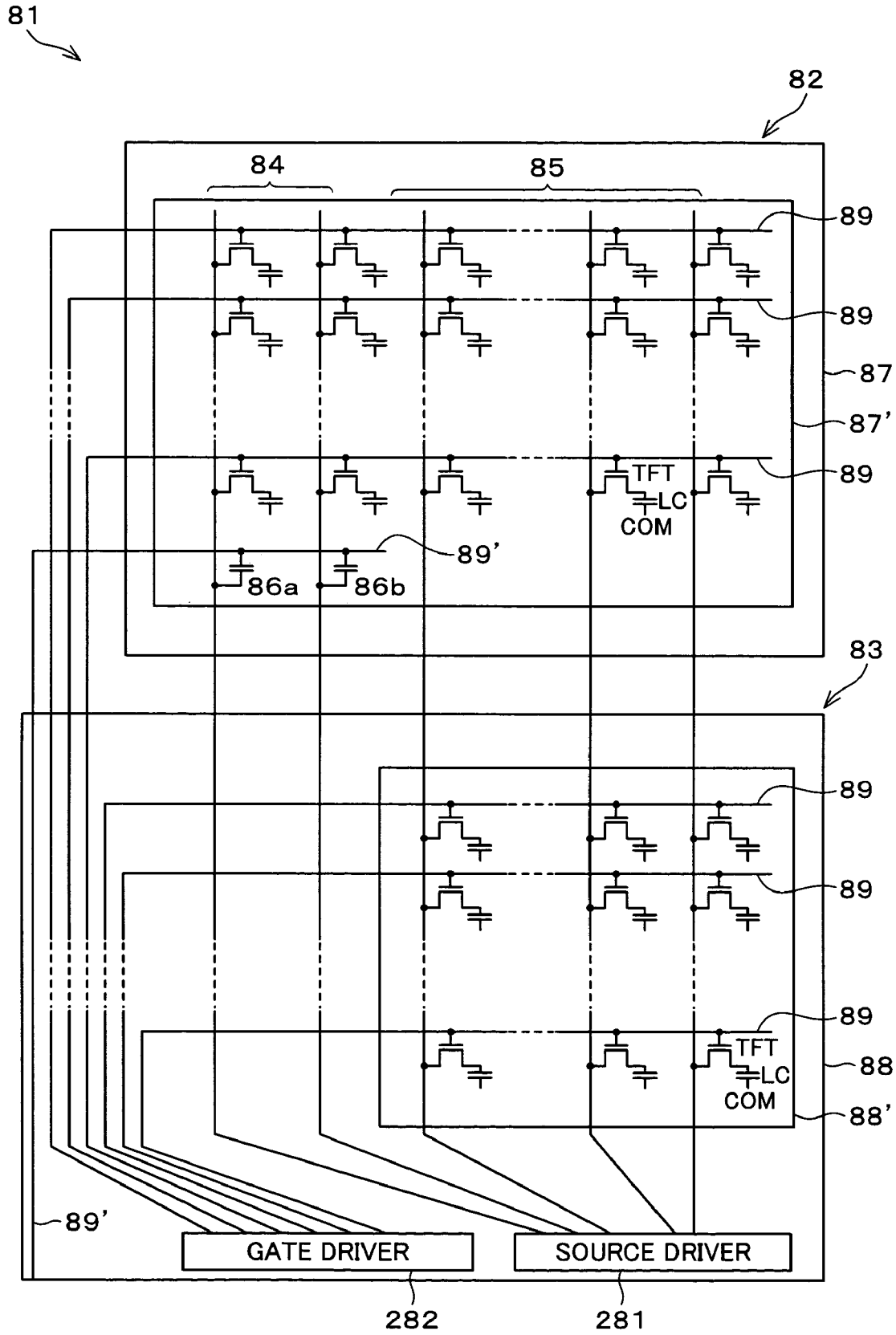
FIG. 16 is a circuit diagram showing an arrangement of a display of embodiment 9 according to the present invention.

FIG. 16 is a circuit diagram showing an arrangement of a display 81 of present embodiment 9. The display 81 is of a twin panel type, composed of a main panel (display panel) 82 and a sub-panel (display panel) 83. The main panel 82 includes a TFT substrate (active matrix substrate) 87 which is a board carrying thin film transistors (TFTs); an opposite substrate 87' placed opposite to the TFT substrate 87; and a liquid crystal layer (LC) as a display medium sandwiched between the TFT substrate 87 and the opposite substrate 87'.

On the TFT substrate 87 are there provided source bus lines (first bus lines) 84, 85 and gate bus lines (second bus lines) 89 in a matrix. The TFTs (switching devices) are disposed near the intersections of the source bus lines 84, 85 and the gate bus lines 89. The TFT is connected to a gate bus line 89 at the gate, a source bus line 84, 85 at the source, and a pixel electrode (not shown in the figure) at the drain. A voltage is then applied to the liquid crystal layer (LC) as a pixel between the pixel electrode and a common electrode (COM) on the opposite substrate 87'. All the TFTs undergo the same process, displaying an image.

The main panel 82 is connected to the sub-panel 83 through, for example, an FPC (not shown). The connection enables the source driver 281 and the gate driver 282 on the sub-panel 83 to apply source signal voltages and gate signal voltages to the bus lines on the main panel 82 through, for example the wiring and FPC on the sub-panel 83.

The sub-panel 83 includes a TFT substrate (active matrix substrate) 88 which is a board carrying thin film transistors thereon; an opposite substrate 88' placed opposite to the TFT substrate 88; and a liquid crystal layer (LC) as a display medium sandwiched between the TFT substrate 88 and the opposite substrate 88'.

On the TFT substrate 88 for the sub-panel 83 are there provided source bus lines 85 and gate bus lines 89 in a matrix, similarly to the main panel 82. TFTs are laid out near the intersections of the source bus lines 85 and the gate bus lines 89. The TFT is connected to a gate bus line 89 at the gate: a source bus line 85 at the source; and a pixel electrode (not shown) at the drain. A voltage is then applied to the liquid crystal layer (LC) as a pixel between the pixel electrode and a common electrode (COM) on the opposite substrate 88'. All the TFTs undergo the same process, displaying an image.

The sub-panel 83 further includes a source driver 281 and a gate driver 282. The lines extending from the source driver 281 are connected to the source bus lines 84, 85 and those extending from the gate driver 282 are connected to the gate bus lines 89, so that the source driver 281 and the gate driver 282 can apply gate signal voltages and source signal voltages to the respective bus lines.

As in the foregoing, in the display 81 according to present embodiment 9, the source driver 281 and the gate driver 282 are disposed on the sub-panel 83, rather than on the main panel 82. The source bus lines 85 are connected to both the pixel electrodes on the main panel 82 and those on the sub-panel 83, whereas the source bus lines 84 are connected only to the pixel electrodes on the main panel 82. That is, the source bus lines 84 are connected to the pixel electrodes only on the TFT substrate 87 for the main panel 82, and on the TFT substrate 88 for the sub-panel 83, act as wiring which links the lines extending from the source driver 281 to the source bus lines 84 on the main panel 82. The source bus lines 85 are therefore capacitance loaded by the sub-panel 83, as well as by the main panel 82, upon driving the main panel 82. On the other hand, the source bus lines 84 are capacitance loaded only by the main panel 82 upon driving the main panel 82.

To eliminate or reduce the difference in capacitance sufficiently so that it does not affect the display, the source bus lines 84 are provided with supplemental capacitances (first capacitances) 86*a*, 86*b*. It is preferable if the values of the capacitances 86*a*, 86*b* are set so as to eliminate or sufficiently reduce the capacitance difference between the source bus lines 84 and the source bus lines 85. The settings allow for no difference between the signal delay on the source bus lines 84 and the signal delay on the source bus lines 85, preventing display defects and other inconveniences from occurring due to signal delay difference.

The values of the capacitances 86*a*, 86*b* may be equal to each other or have such small difference that it does not affect the display. The capacitances may be formed by, for example, arranging the source bus lines 84 and the common signal lines 89' to cross separated by, for example, an insulating film intervening there between, or by any other method including those discussed in embodiment 1.

Embodiment 10

Figure 17:
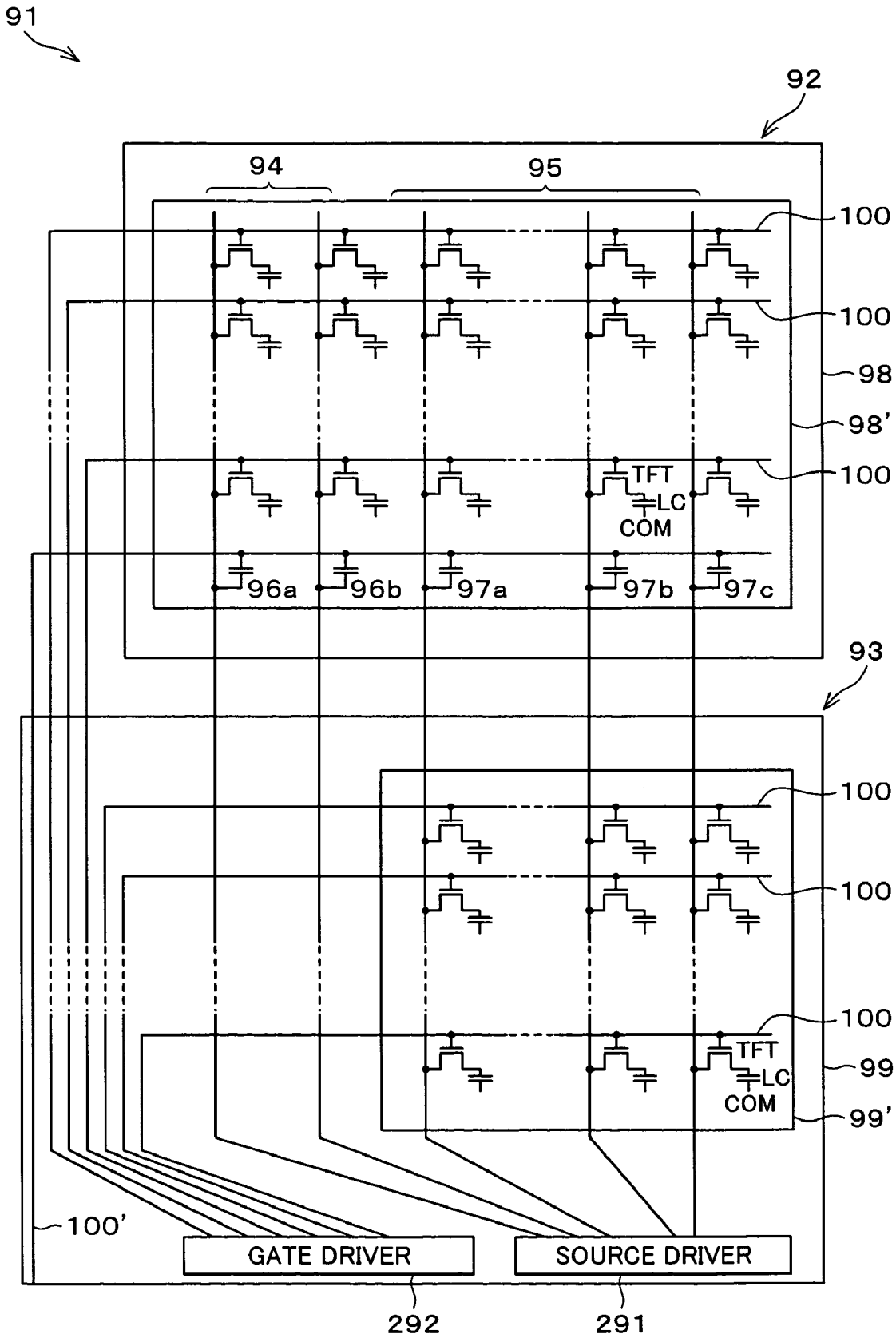
FIG. 17 is a circuit diagram showing an arrangement of a display of embodiment 10 according to the present invention.

Embodiment 10 of the present invention will be now discussed. FIG. 17 is a circuit diagram showing an arrangement of a display 91 of present embodiment 10.

Referring to FIG. 17, the display 91 according to embodiment 10 is of a twin panel type and includes a main panel (display panel) 92 and a sub-panel (display panel) 93. On the main panel 92 and the sub-panel 93 are there provided source bus lines (first bus lines) 94, 95 and gate bus lines (second bus lines) 100 in a matrix. Similarly to the display discussed in embodiment 9 above, in the display 91 according to the present embodiment, the source driver 291 and the gate driver 292 are disposed on the sub-panel 93, rather than on the main panel 92 which is connected to the sub-panel 93 through, for example, an FPC (not shown).

The source bus lines 95 are connected to both the pixel electrodes on the main panel 92 and those on the sub-panel 93, whereas the source bus lines 94 are connected only to the pixel electrodes on the main panel 92. That is, the source bus lines 94 are connected to the pixel electrodes only on the TFT substrate 98 for the main panel 92, and on the TFT substrate 99 for the sub-panel 93, act as wiring which links the lines extending from the source driver 291 to the source bus lines 94 on the main panel 92.

The source bus lines 94 have supplemental capacitances (first capacitances) 96*a*, 96*b* near the respective intersections with the common signal lines 100'. The source bus lines 95 have supplemental capacitances (second capacitances) 97*a*, 97*b*, 97*c* near the respective intersections with the common signal lines 100'.

Similarly to the case of the display 81, in the display 91, the source bus lines 94 connected to the pixel electrodes only on the main panel 92 differ in capacitance from the source bus lines 95 connected to the pixel electrodes on both the main panel 92 and the sub-panel 93. Accordingly, to eliminate or reduce the difference in capacitance sufficiently so that it does not affect the display, the capacitances 96*a*, 96*b* for the source bus lines 94 are greater than the capacitances 97*a*, 97*b*, 97*c* for the source bus lines 95. In other words, it is preferable if the values of the capacitances 96*a*, 96*b*, as well as 97*a*, 97*b*, 97*c*, are set so as to eliminate or sufficiently reduce the capacitance difference between the source bus lines 94 and the source bus lines 95. The settings allow for no difference between the signal delay on the source bus lines 94 and the signal delay on the source bus lines 95, preventing display defects and other inconveniences from occurring due to signal delay difference.

The values of the capacitances 96*a*, 96*b* may be exactly equal to each other or have such small difference that it does not affect the display. The values of the capacitances 97*a*, 97*b*, 97*c* may be exactly equal to each other or have such small difference that it does not affect the display. The capacitances may be formed by, for example, arranging the source bus lines 94, 95 and the common signal lines 100' to cross separated by, for example, an insulating film intervening there between, or by any other method including those discussed in embodiment 1.

Embodiment 11

Figure 18:
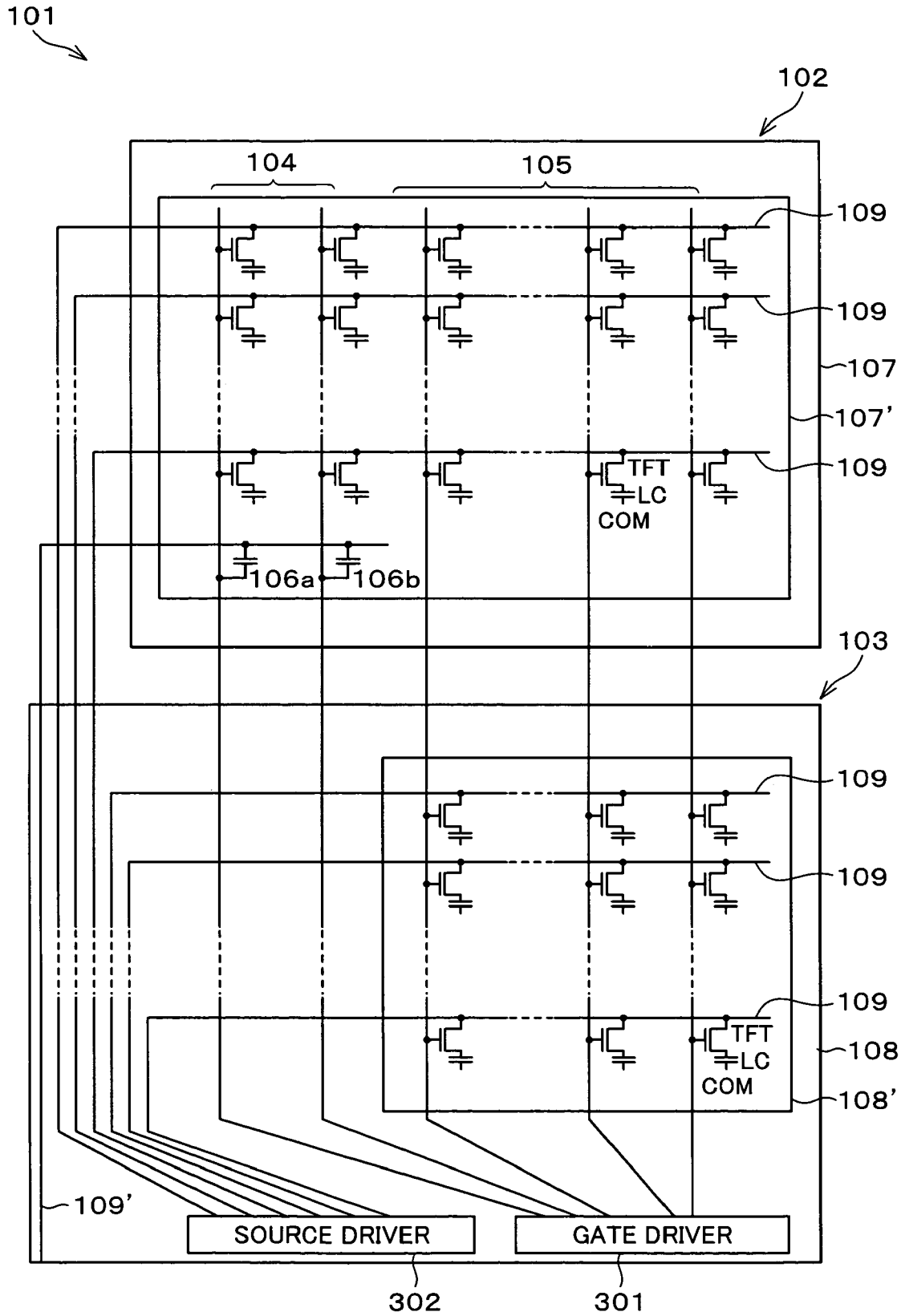
FIG. 18 is a circuit diagram showing an arrangement of a display of embodiment 11 according to the present invention.

Embodiment 11 of the present invention will be now discussed. FIG. 18 is a circuit diagram showing an arrangement of a display 101 of present embodiment 11.

Referring to FIG. 18, the display 101 according to the embodiment 11 is of a twin panel type and includes a main panel (display panel) 102 and a sub-panel (display panel) 103. On the main panel 102 and the sub-panel 103 are there provided gate bus lines (first bus lines) 104, 105 and source bus lines (second bus lines) 109 in a matrix. Similarly to the display discussed in embodiment 9 above, in the display 101 according to the present embodiment, the gate driver 301 and the source driver 302 are disposed on the sub-panel 103, rather than on the main panel 102 which is connected to the sub-panel 103 through, for example, an FPC (not shown).

The gate bus lines 105 are connected to both the pixel electrodes on the main panel 102 and those on the sub-panel 103, whereas the gate bus lines 104 are connected only to the pixel electrodes on the main panel 102. That is, the gate bus lines 104 are connected to the pixel electrodes only on the TFT substrate 107 for the main panel 102, and on the TFT substrate 108 for the sub-panel 103, act as wiring which links the lines extending from the gate driver 301 to the gate bus lines 104 on the main panel 102.

The gate bus lines 104 have supplemental capacitances (first capacitances) 106*a*, 106*b* near the respective intersections with the common signal lines 109'. The position of the gate driver 301 and the source driver 302 in the display 101 of embodiment 11 is reversed when compared to that in the display 81 of embodiment 9; accordingly, the position of the gate bus lines 104, 105 and the source bus lines 109 is also reversed when compared to that in the display 101.

In the display 101, the gate bus lines 104 connected to the pixel electrodes only on the main panel 102 differ in capacitance from the gate bus lines 105 connected to the pixel electrodes on both the main panel 102 and the sub-panel 103. The gate bus lines 105 are therefore capacitance loaded by the sub-panel 103, as well as by the main panel 102, upon driving the main panel 102. On the other hand, the gate bus lines 104 are capacitance loaded only by the main panel 102 upon driving the main panel 102.

To eliminate or reduce the difference in capacitance sufficiently so that it does not affect the display, the supplemental capacitances 106*a*, 106*b* are formed on the gate bus lines 104 disposed only on the TFT substrate 107 for the main panel 102. The formation allows for no difference between the signal delay on the gate bus lines 104 and the signal delay on the gate bus lines 105, preventing display defects and other inconveniences from occurring due to signal delay difference.

The values of the capacitances 106*a*, 106*b* may be exactly equal to each other or have such small difference that it does not affect the display. The capacitances may be formed by, for example, arranging the gate bus lines 104, 105 and the common signal lines 109' to cross separated by, for example, an insulating film intervening there between, or by any other method including those discussed in embodiment 1.

Embodiment 12

Figure 19:
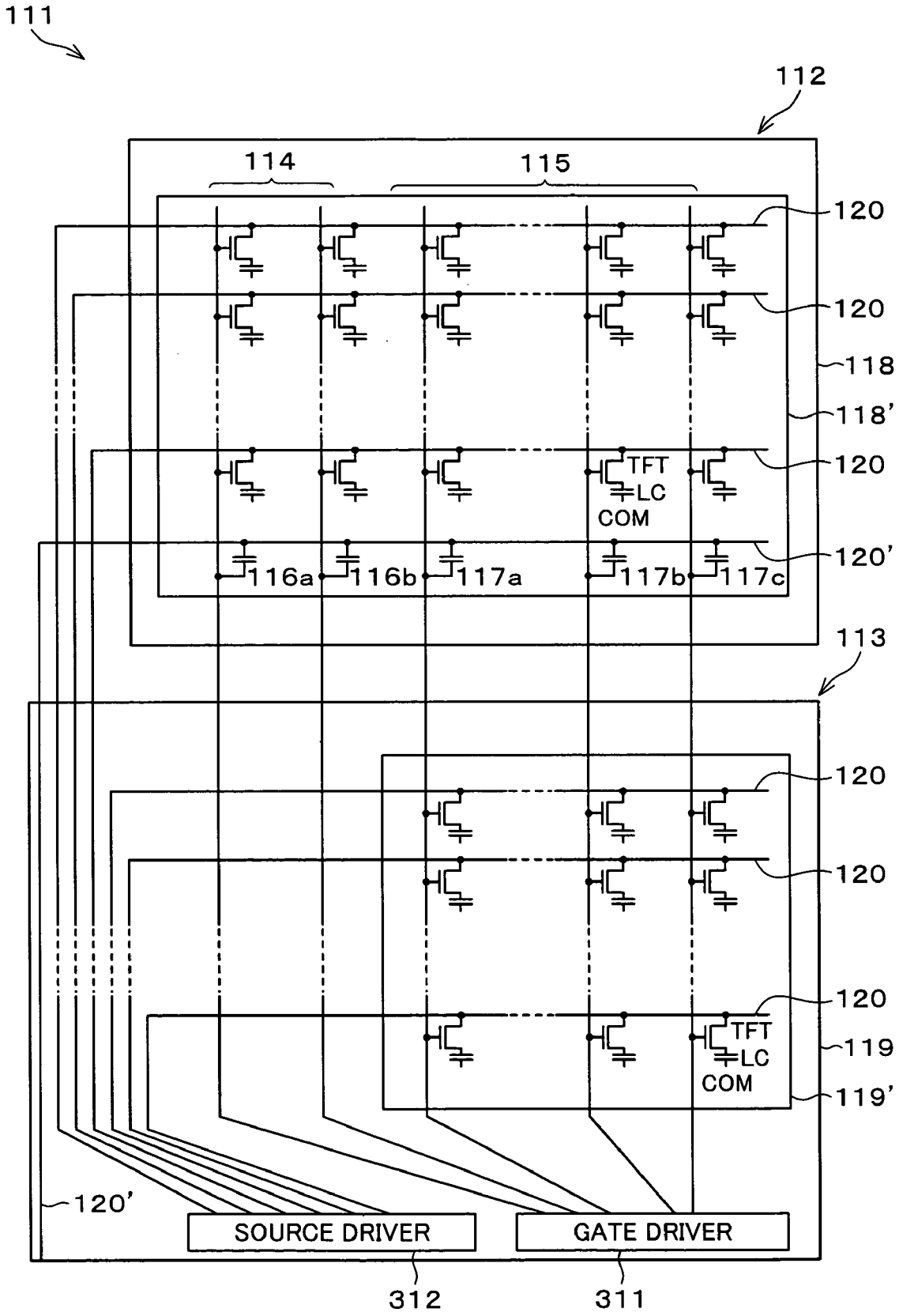
FIG. 19 is a circuit diagram showing an arrangement of a display of embodiment 12 according to the present invention.

Embodiment 12 of the present invention will be now discussed. FIG. 19 is a circuit diagram showing an arrangement of a display 111 of present embodiment 12.

Referring to FIG. 19, the display 111 according to embodiment 12 is of a twin panel type and includes a main panel (display panel) 112 and a sub-panel (display panel) 113. On the main panel 112 and the sub-panel 113 are there provided gate bus lines (first bus lines) 114, 115 and source bus lines (second bus lines) 120 in a matrix. Similarly to the display discussed in embodiment 9 above, in the display 111 according to the present embodiment, the gate driver 311 and the source driver 312 are disposed on the sub-panel 113, rather than on the main panel 112 which is connected to the sub-panel 113 through, for example, an FPC (not shown).

The gate bus lines 115 are connected to both the pixel electrodes on the main panel 112 and those on the sub-panel 113, whereas the gate bus lines 114 are connected only to the pixel electrodes on the main panel 112. That is, the gate bus lines 114 are connected to the pixel electrodes only on the TFT substrate 118 for the main panel 112, and on the TFT substrate 119 for the sub-panel 113, act as wiring which links the lines extending from the gate driver 311 to the gate bus lines 114 on the main panel 112.

The gate bus lines 114 have supplemental capacitances (first capacitances) 116*a*, 116*b* near the respective intersections with the common signal lines 120'. The gate bus lines 115 have supplemental capacitances (second capacitances) 117*a*, 117*b*, 117*c* near the respective intersections with the common signal lines 120'. The display 111 in embodiment 12 has the same arrangement as the display 101 in embodiment 11, except how the supplemental capacitances are formed.

Similarly to the case of the display 101, in the display 111, the gate bus lines 0.114 connected to the pixel electrodes only on the main panel 112 differ in capacitance from the gate bus lines 115 connected to the pixel electrodes on both the main panel 112 and the sub-panel 113. Accordingly, to eliminate or reduce the difference in capacitance sufficiently so that it does not affect the display, the capacitances 116*a*, 116*b* for the gate bus lines 114 are greater than the capacitances 117*a*, 117*b*, 117*c* for the gate bus lines 115. In other words, it is preferable if the values of the capacitances 116*a*, 116*b*, as well as 117*a*, 117*b*, 117*c*, are set so as to eliminate or sufficiently reduce the capacitance difference between the gate bus lines 114 and the gate bus lines 115. The settings allow for no difference between the signal delay on the gate bus lines 114 and the signal delay on the gate bus lines 115, preventing display defects and other inconveniences from occurring due to signal delay difference.

The values of the capacitances 116*a*, 116*b* may be exactly equal to each other or have such small difference that it does not affect the display. The values of the capacitances 117*a*, 117*b*, 117*c* may be exactly equal to each other or have such small difference that it does not affect the display. The capacitances may be formed by, for example, arranging the gate bus lines 114, 115 and the common signal lines 120' to cross separated by, for example, an insulating film intervening there between, or by any other method including those discussed in embodiment 1.

Embodiment 13

Figure 20:
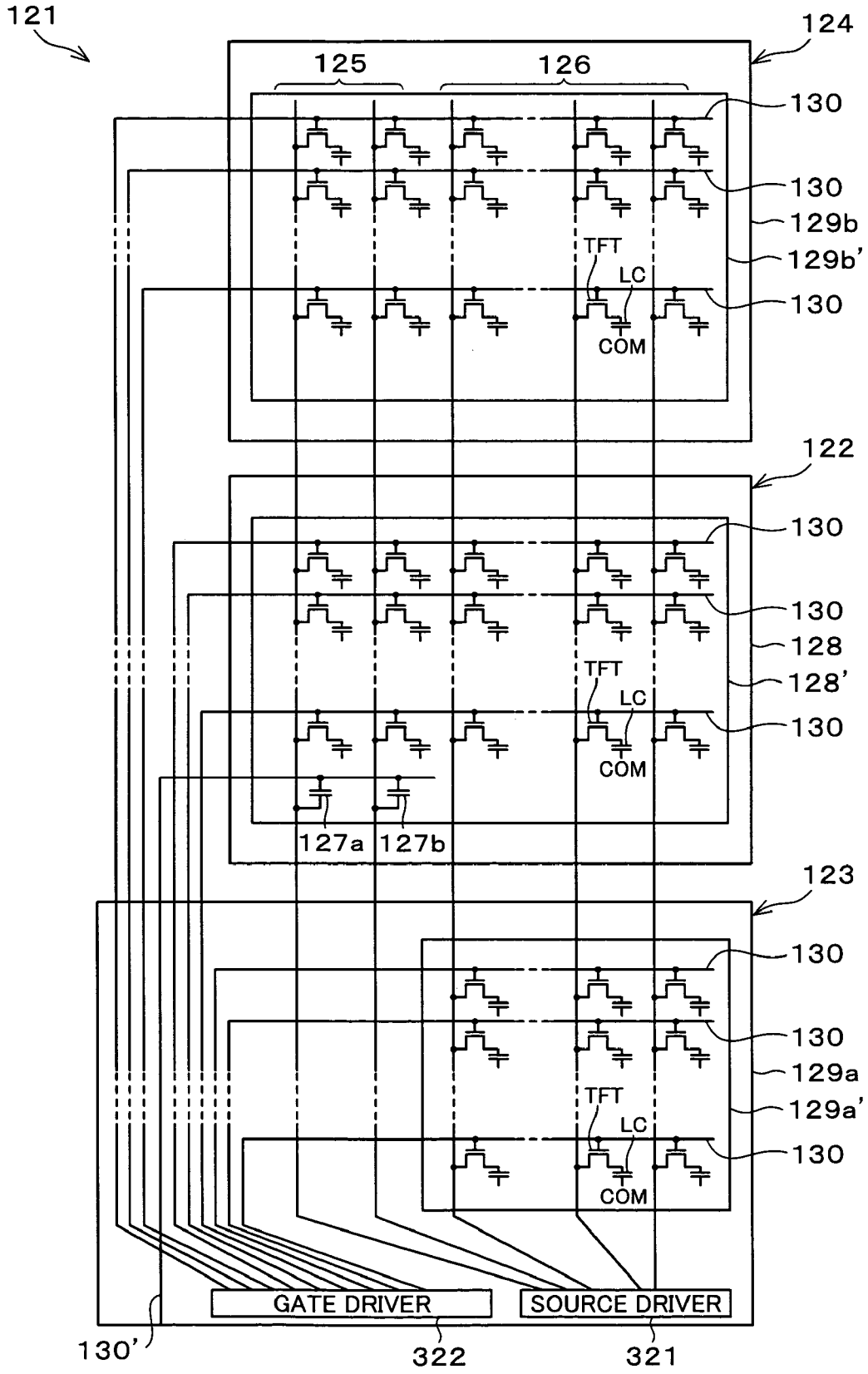
FIG. 20 is a circuit diagram showing an arrangement of a display of embodiment 13 according to the present invention.

Embodiment 13 of the present invention will be now discussed. FIG. 20 is a circuit diagram showing an arrangement of a display 121 of present embodiment 13.

As shown in FIG. 20, the display 121 according to embodiment 13 includes a main panel 122 (display panel) and two sub-panels (display panels) 123, 124. On the main panel 122 and the sub-panels 123, 124 are there provided source bus lines (first bus lines) 125, 126 and gate bus lines (second bus lines) 130 in a matrix. Similarly to the display discussed in embodiment 9 above, in the display 121 according to the present embodiment, the source driver 321 and the gate driver 322 are disposed on the sub-panel 123, rather than on the main panel 122 which is connected to the sub-panel 123 through, for example, an FPC (not shown). Further, the another sub-panel 124 is connected to the main panel 122 through, for example, an FPC (not shown).

The source bus lines 126 are connected to the pixel electrodes on the main panel 122 and the two sub-panels 123, 124, whereas the source bus lines 125 are connected only to the pixel electrodes on the main panel 122 and those on the sub-panel 124. That is, the source bus lines 125 are connected to the pixel electrodes only on the TFT substrates 128, 129*b* for the main panel 122 and the sub-panel 124, and on the TFT substrate 129*a* for the sub-panel 123, act as wiring which links the lines extending from the source driver 321 to the source bus lines 125 on the main panel 122.

The source bus lines 125 have supplemental capacitances (first capacitances) 127*a*, 127*b* near the respective intersections with the common signal lines 130'. The display 121 according to embodiment 13 has the same arrangement as the display 81 according to embodiment 9, except that the former includes two sub-panels.

In the display 121, the source bus lines 125 connected to the pixel electrodes only on the main panel 122 and the sub-panel 124 differ in capacitance from the source bus lines 126 connected to the pixel electrodes on all the panels. The source bus lines 125 are therefore capacitance loaded by the sub-panels 123, 124, as well as by the main panel 122, upon driving the main panel 122. On the other hand, the source bus lines 125 are not capacitance loaded by the sub-panel 123 upon driving the main panel 122, developing a difference in capacitance.

To eliminate or reduce the difference in capacitance sufficiently so that it does not affect the display, the supplemental capacitances 127*a*, 127*b* are formed on the source bus lines 125 disposed only on the TFT substrate 128 for the main panel 122. The formation allows for no difference between the signal delay on the source bus lines 125 and the signal delay on the source bus lines 126, preventing display defects and other inconveniences from occurring due to signal delay difference.

The values of the capacitances 127*a*, 127*b* may be exactly equal to each other or have such small difference that it does not affect the display. The capacitances may be formed by, for example, arranging the source bus lines 125 and the common signal lines 130' to cross separated by, for example, an insulating film intervening there between, or by any other method including those discussed in embodiment 1.

Embodiment 14

Figure 21:
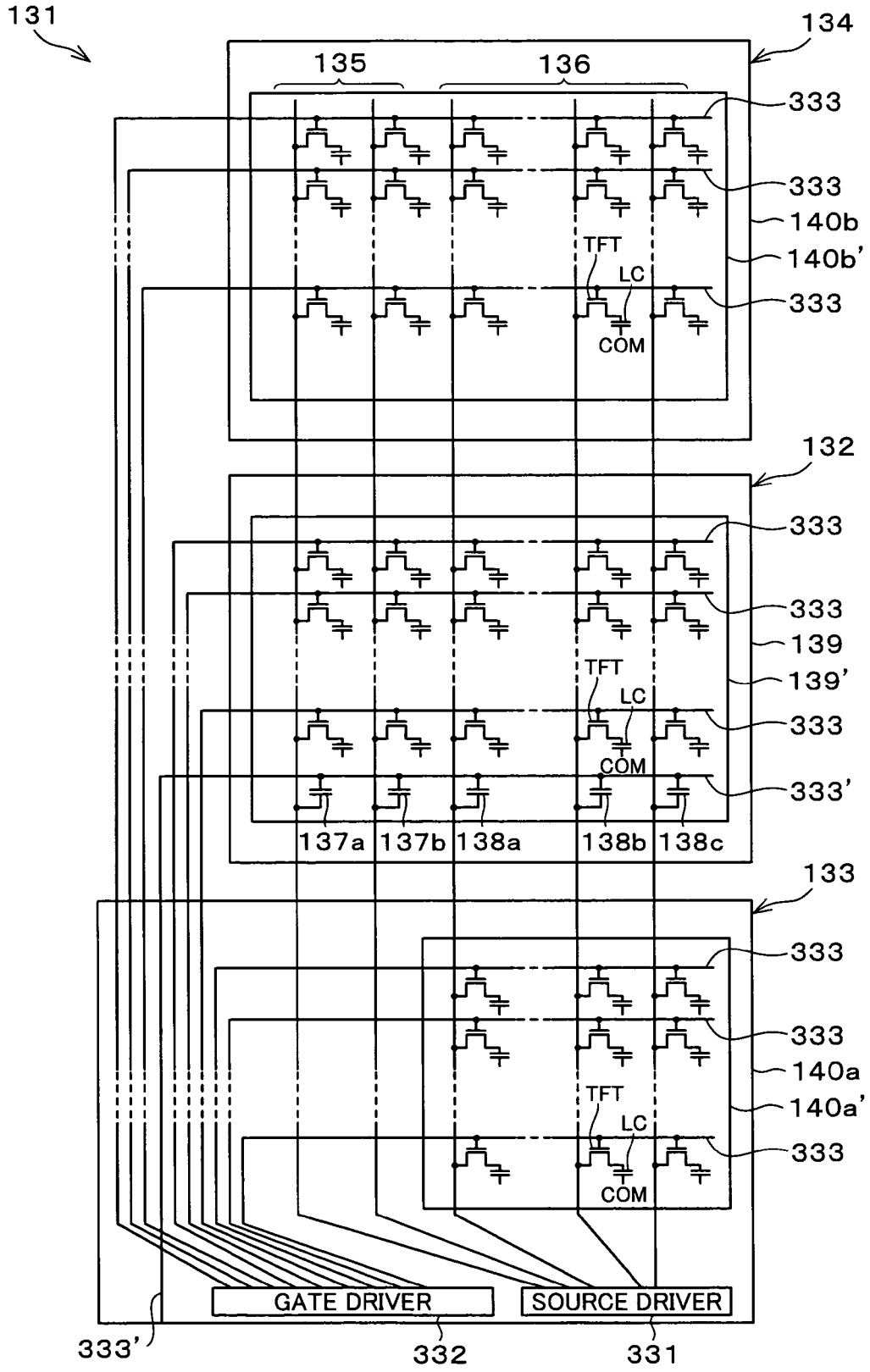
FIG. 21 is a circuit diagram showing an arrangement of a display of embodiment 14 according to the present invention.

Embodiment 14 of the present invention will be now discussed. FIG. 21 is a circuit diagram showing an arrangement of a display 131 of present embodiment 14.

As shown in FIG. 21, the display 131 according to embodiment 14 includes a main panel (display panel) 132 and two sub-panels (display panel) 133, 134. On the main panel 132 and the sub-panels 133, 134 are there provided source bus lines (first bus lines) 135, 136 and gate bus lines (second bus lines) 333 in a matrix. Similarly to the display discussed in embodiment 9 above, in the display 131 according to the present embodiment, the source driver 331 and the gate driver 332 are disposed on the sub-panel 133, rather than on the main panel 132 which is connected to the sub-panel 133 through, for example, an FPC (not shown). Further, the another sub-panel 134 is connected to the main panel 132 through, for example, an FPC (not shown).

The source bus lines 136 are connected to all the pixel electrodes on the main panel 132 and the two sub-panels 133, 134, whereas the source bus lines 135 are connected only to the pixel electrodes on the main panel 132 and those on the sub-panel 134. That is, the source bus lines 135 are connected to the pixel electrodes only on the TFT substrates 139, 140*b* for the main panel 132 and the sub-panel 134, and on the TFT substrate 140*a* for the sub-panel 133, act as wiring which links the lines extending from the source driver 331 to the source bus lines 135 on the main panel 132.

The source bus lines 135 have supplemental capacitances (first capacitances) 137*a*, 137*b* near the respective intersections with the common signal lines 333'. The source bus lines 136 have supplemental capacitances (second capacitances) 138*a*, 138*b*, 138*c* near the respective intersections with the common signal lines 333'. The display 131 in embodiment 14 has the same arrangement as the display 121 in embodiment 13, except how the supplemental capacitances are formed.

Similarly to the aforementioned embodiment, in the display 131, the source bus lines 135 connected to the pixel electrodes only on the main panel 132 and the sub-panel 134 differ in capacitance from the source bus lines 136 connected to the pixel electrodes on all the panels. Accordingly, to eliminate or reduce the difference in capacitance sufficiently so that it does not affect the display, the capacitances 137*a*, 137*b* for the source bus lines 135 are greater than the capacitances 138*a*, 138*b*, 138*c* for the source bus lines 136. In other words, it is preferable if the values of the capacitances 137*a*, 137*b*, as well as 138*a*, 138*b*, 138*c*, are set so as to eliminate or sufficiently reduce the capacitance difference between the source bus lines 135 and the source bus lines 136. The settings allow for no difference between the signal delay on the source bus lines 135 and the signal delay on the source bus lines 136, preventing display defects and other inconveniences from occurring due to signal delay difference.

The values of the capacitances 137*a*, 137*b* may be exactly equal to each other or have such small difference that it does not affect the display. The values of the capacitances 138*a*, 138*b*, 138*c* may be exactly equal to each other or have such small difference that it does not affect the display. The capacitances may be formed by, for example, arranging the source bus lines 135, 136 and the common signal lines 333' to cross separated by, for example, an insulating film intervening there between, or by any other method including those discussed in embodiment 1.

Embodiment 15

Figure 22:
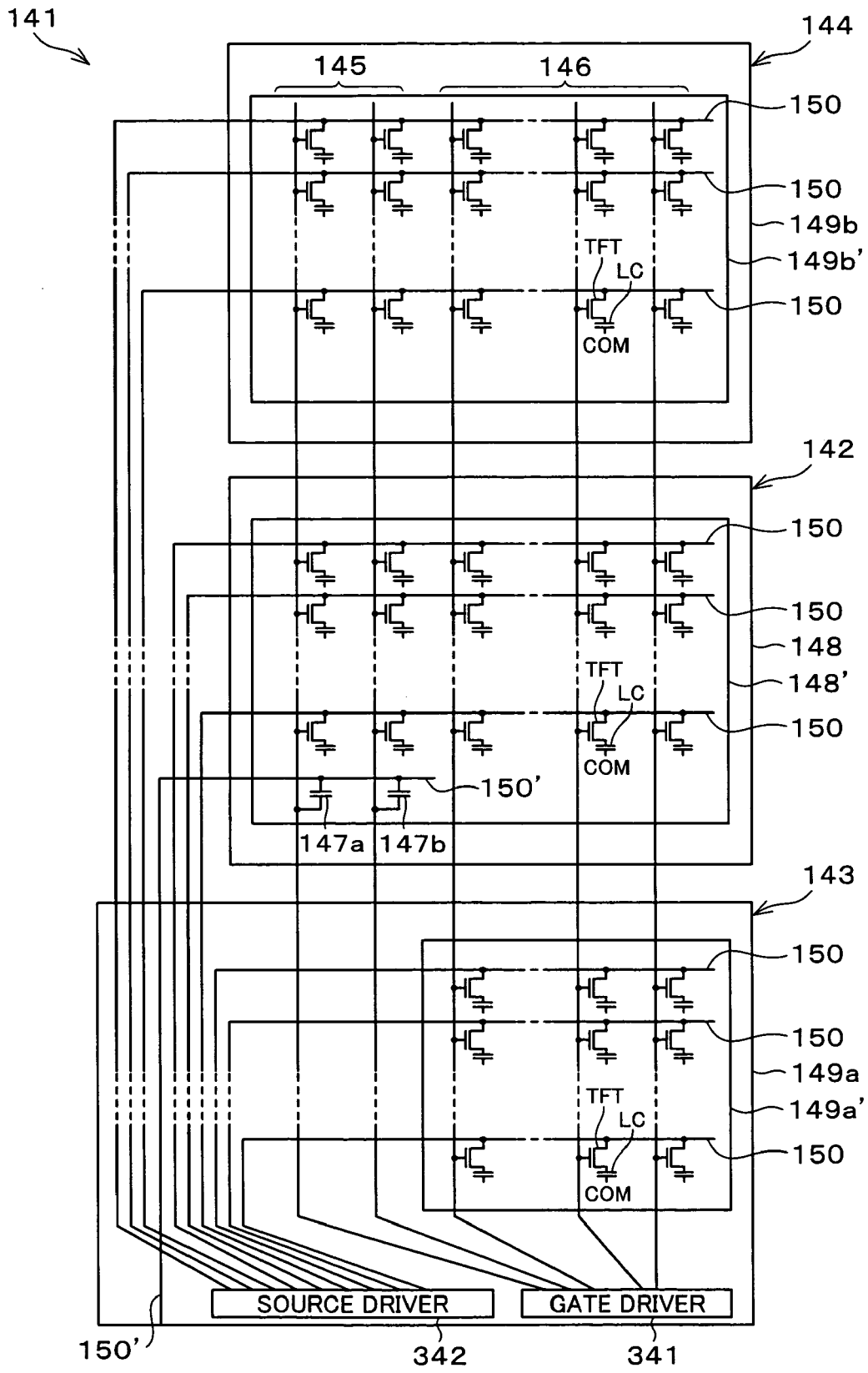
FIG. 22 is a circuit diagram showing an arrangement of a display of embodiment 15 according to the present invention.

Embodiment 15 of the present invention will be now discussed. FIG. 22 is a circuit diagram showing an arrangement of a display 141 of the present embodiment 15.

As shown in FIG. 22, the display 141 according to embodiment 15 includes a main panel (display panel) 142 and two sub-panels (display panel) 143, 144. On the main panel 142 and the sub-panels 143, 144 are there provided gate bus lines (first bus lines) 145, 146 and source bus lines (second bus lines) 150 in a matrix. Similarly to the display discussed in embodiment 9 above, in the display 141 according to the present embodiment, the gate driver 341 and the source driver 342 are disposed on the sub-panel 143, rather than on the main panel 142 which is connected to the sub-panel 143 through, for example, an FPC (not shown). Further, the sub-panel 144 connected to the main panel 142 through, for example, an FPC (not shown).

The gate bus lines 146 are connected to all the pixel electrodes on the main panel 142 and the two sub-panels 143, 144, whereas the gate bus lines 145 are connected only to the pixel electrodes on the main panel 142 and those on the sub-panel 144. That is, the gate bus lines 145 are connected to the pixel electrodes only on the TFT substrates 148, 149*b* for the main panel 142 and the sub-panel 144, and on the TFT substrate 149*a* for the sub-panel 143, act as wiring which links the lines extending from the gate driver 341 to the gate bus lines 145 on the main panel 142.

The gate bus lines 145 have supplemental capacitances (first capacitances) 147*a*, 147*b* near the respective intersections with the common signal lines 150'. The position of the gate driver 341 and the source driver 342 in the display 141 of embodiment 15 is reversed when compared to that in the display 121 of embodiment 13; accordingly, the position of the gate bus lines 145, 146 and the source bus lines 150 is also reversed when compared to that in the display 121.

Similarly, to the aforementioned embodiment, in the display 141, the gate bus lines 145 connected to the pixel electrodes only on the main panel 142 and the sub-panel 144 differ in capacitance from the gate bus lines 146 connected to the pixel electrodes on all the panels. The gate bus lines 146 are therefore capacitance loaded by the sub-panels 143, 144, as well as by the main panel 142, upon driving the main panel 142. On the other hand, the gate bus lines 145 are not capacitance loaded by the sub-panel 143 upon driving the main panel 142, developing a difference in capacitance.

To eliminate or reduce the difference in capacitance sufficiently so that it does not affect the display, the supplemental capacitances 147*a*, 147*b* are formed on the gate bus lines 145 disposed only on the TFT substrate 148 for the main panel 142. The formation allows for no difference between the signal delay on the gate bus lines 145 and the signal delay on the gate bus lines 146, preventing display defects and other inconveniences from occurring due to signal delay difference.

The values of the capacitances 147*a*, 147*b* may be exactly equal to each other or have such small difference that it does not affect the display. The capacitances may be formed by, for example, arranging the gate bus lines 145 and the common signal lines 150' to cross separated by, for example, an insulating film intervening there between, or by any other method including those discussed in embodiment 1.

Embodiment 16

Figure 23:
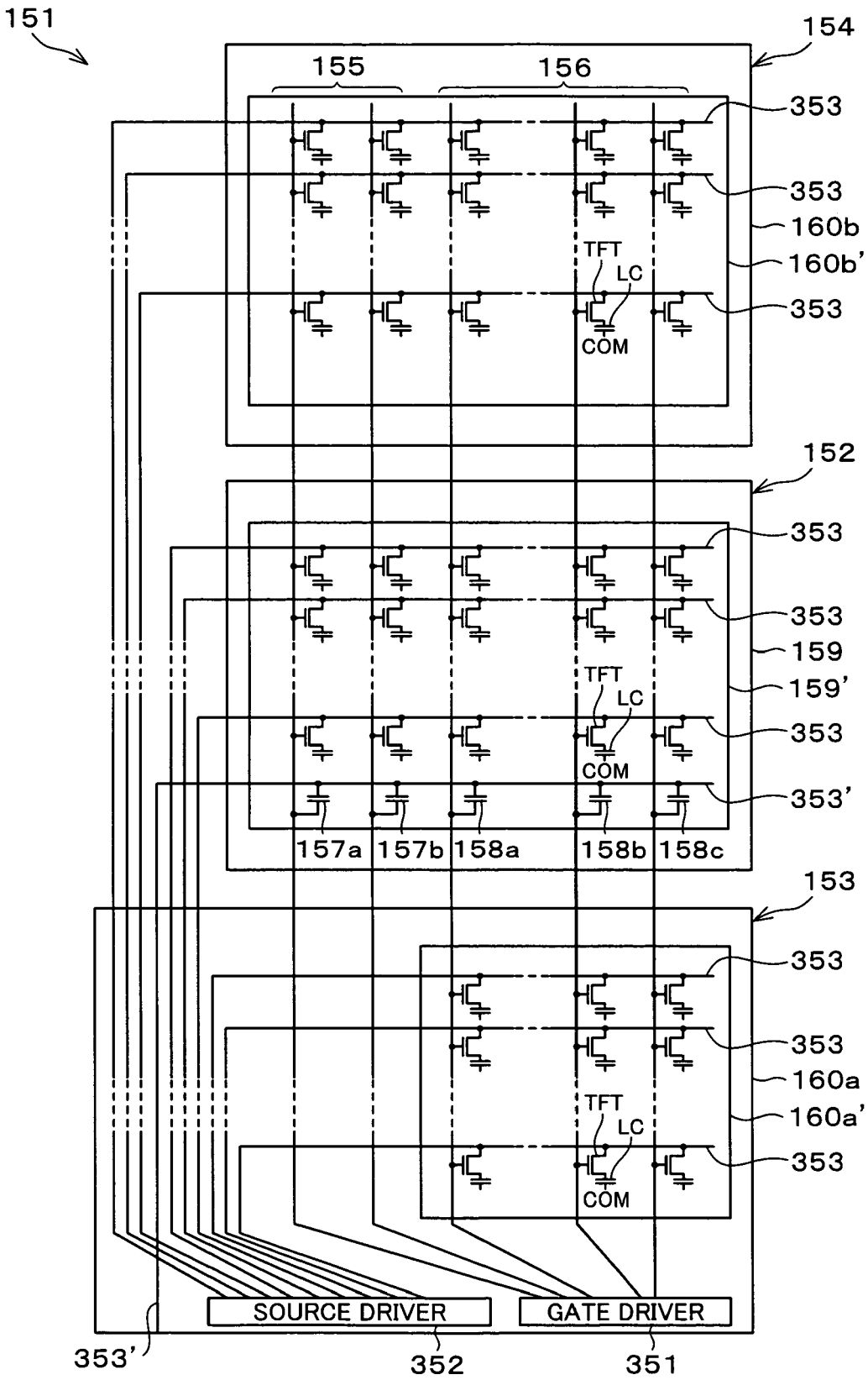
FIG. 23 is a circuit diagram showing an arrangement of a display of embodiment 16 according to the present invention.

Embodiment 16 of the present invention will be now discussed. FIG. 23 is a circuit diagram showing an arrangement of a display 151 of present embodiment 16.

As shown in FIG. 23, the display 151 according to embodiment 16 includes a main panel (display panel) 152 and two sub-panels (display panel) 153, 154. On the main panel 152 and the sub-panels 153, 154 are there provided gate bus lines (first bus lines) 155, 156 and source bus lines (second bus lines) 353 in a matrix. Similarly to the display discussed in embodiment 9 above, in the display 151 according to the present embodiment, the gate driver 351 and the source driver 352 are disposed on the sub-panel 153, rather than on the main panel 152, which is connected to the sub-panel 153 through, for example, an FPC (not shown). Further, the sub-panel 154 is connected to the main panel 152 through, for example, an FPC (not shown).

The gate bus lines 156 is connected to all the pixel electrodes on the main panel 152 and the two sub-panels 153, 154, whereas the gate bus lines 155 are connected only to the pixel electrodes on the main panel 152 and those on the sub-panel 154. That is, the gate bus lines 155 are connected to the pixel electrodes only on the TFT substrates 159, 160*b* for the main panel 152 and the sub-panel 154, and on the TFT substrate 160*a* for the sub-panel 153, act as the lines extending from the gate driver 351 to the gate bus lines 155 on the main panel 152.

The gate bus lines 155 have supplemental capacitances (first capacitances) 157*a*, 157*b* near the respective intersections with the common signal lines 353'. The gate bus lines 156 have supplemental capacitances (second capacitances) 158*a*, 158*b*, 158*c* near the respective intersections with the common signal lines 353'. The display 151 in embodiment 16 has the same arrangement as the display 141 in embodiment 15, except how the supplemental capacitances are formed.

Similarly to the aforementioned embodiment, in the display 151, the gate bus lines 155 connected to the pixel electrodes only on the main panel 152 and the sub-panel 154 differ in capacitance from the gate bus lines 156 connected to the pixel electrodes on all the panels. Accordingly, to eliminate or reduce the difference in capacitance sufficiently so that it does not affect the display, the capacitances 157*a*, 157*b* for the gate bus lines 155 are greater than the capacitances 158*a*, 158*b*, 158*c* for the gate bus lines 156. In other words, it is preferable if the values of the capacitances 157*a*, 157*b*, as well as 158*a*, 158*b*, 158*c*, are set so as to eliminate or sufficiently reduce the capacitance difference between the gate bus lines 155 and the gate bus lines 156. The settings allow for no difference between the signal delay on the gate bus lines 155 and the signal delay on the gate bus lines 156, preventing display defects and other inconveniences from occurring due to signal delay difference.

The values of the capacitances 157*a*, 157*b* may be exactly equal to each other or have such small difference that it does not affect the display. The values of the capacitances 158*a*, 158*b*, 158*c* may be exactly equal to each other or have such small difference that it does not affect the display. The capacitances may be formed by, for example, arranging the gate bus lines 155, 156 and the common signal lines 353' to cross separated by, for example, an insulating film intervening there between, or by any other method including those discussed in embodiment 1.

Note that the embodiments above omits some of the source bus lines and the gate bus lines for convenience where appropriate. In the present invention, the source bus lines and the gate bus lines may be varied in number, where necessary according to the size of the display panels. The number of display panels in displays according to the present invention is not necessarily limited to two or three—cases discussed in the aforementioned embodiments—, and may be determined as necessary.

In the active matrix substrate according to the present invention, the first bus lines on which the first capacitances are formed may be connected to lines on another active matrix substrate which are not connected to a pixel electrode.

According to the arrangement, a driver driving the first bus lines is disposed on another active matrix substrate having fewer first bus lines connected to pixel electrodes, rather than on an active matrix substrate having more first bus lines connected to pixel electrodes.

In the active matrix substrate, the first bus lines having no first capacitance formed thereon may have a second capacitance formed thereon which is less than the first capacitance.

That is, in the active matrix substrate, the first bus lines shared for use by another active matrix substrate have a second capacitance formed thereon which is smaller, and the first bus lines not shared for use by another active matrix substrate have a first capacitance formed thereon which is greater. Thus, each first bus line has a capacitance which is adjusted as necessary, ensuring reduction of capacitance difference from one bus line to another and production of a good image display.

In the active matrix substrate, the first bus lines may be connected to a source driver, and the second bus lines may be connected to a gate driver.

The arrangement reduces source signal delay difference among the first bus lines and therefore produces a good display with no block split or other display defects occurring.

In the active matrix substrate, the first bus lines may be connected to a gate driver, and the second bus lines may be connected to a source driver.

The arrangement reduces gate signal delay difference among the first bus lines and therefore produces a good display with no block split or other display defects occurring.

The present invention's scope encompasses display devices incorporating the aforementioned active matrix substrate. Such a display device has reduced source or gate signal delay difference among the first bus lines and therefore produces a good display without causing block split and other display defects.

The display according to the present invention may be such that the first bus lines shared among the display panels each have a second capacitance formed thereon which is less than the first capacitance.

In the active matrix substrate in the display, the first bus lines not shared among the display panels have a relatively large first capacitance formed thereon, and the other first bus lines have a relatively small second capacitance formed thereon.

According to the arrangement, capacitance can be adjusted for each first bus line if necessary. This better ensures reductions in capacitance difference between the bus lines and production of a good image display.

In the display, the first bus lines with no first capacitance formed thereon may have a second capacitance formed thereon which is less than the first capacitance.

In the active matrix substrate in the display, the first bus lines not connected to pixel electrodes at least one of the display panels have the relatively large first capacitance formed thereon, and the other first bus lines have the relatively small second capacitance formed thereon.

According to the arrangement, capacitance can be adjusted for each first bus line if necessary. This better ensures reductions in capacitance difference between the bus lines and production of a good image display.

Each of the foregoing displays may further include a source driver and a gate driver applying a signal voltage to the first bus lines and the second bus lines, with the first bus lines connected to the source driver and the second bus lines connected to the gate driver.

Alternatively, the display may further include a source driver and a gate driver applying a signal voltage to the first bus lines and the second bus lines, with the first bus lines connected to the gate driver and the second bus lines connected to the source driver.

In addition, the display may be such that one of the display panels is designated as a main panel, and the display panels, except for the main panel, are designated as sub-panels having less display pixels than the main panel.

According to the arrangement, a display is obtained in which all display panels with different numbers of display pixels are capable of a good display, without causing block split and other display defects due to signal delay difference among the first bus lines.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An active matrix substrate, comprising:

first bus lines and second bus lines arranged to form a matrix; switching devices provided near respective intersections of the first bus lines and the second bus lines; and pixel electrodes electrically connected to the first bus lines and the second bus lines through the switching devices, wherein:

at least one of the first bus lines has a first capacitance formed thereon, the first bus lines, except for the at least one first bus line with a first capacitance, are connected to first bus lines on another active matrix substrate, and the first capacitance is formed by arranging (i) a first bus line not connected to first bus lines on another active matrix substrate and (ii) a line other than the second bus lines to cross each other.

2. The active matrix substrate as set forth in claim 1, wherein the at least one first bus line with a first capacitance is connected to a line connected to no pixel electrode on the other active matrix substrate.

3. The active matrix substrate as set forth in claim 1, wherein each of those first bus lines which have no first capacitance formed thereon has a second capacitance formed thereon which is less than the first capacitance.

4. The active matrix substrate as set forth in claim 1, wherein the first bus lines are connected to a source driver, and the second bus lines are connected to a gate driver.

5. The active matrix substrate as set forth in claim 1, wherein the first bus lines are connected to a gate driver, and the second bus lines are connected to a source driver.

6. The active matrix substrate as set forth in claim 1, wherein an amount of the first capacitance is such that there is substantially no difference in signal delay on each first bus line of the active matrix substrate that is connected to a first bus line on the other active matrix substrate and signal delay on the at least one first bus line with a first capacitance.

7. The active matrix substrate as set forth in claim 1, wherein the active matrix substrate has a display area and the first capacitance is formed outside the display area.

8. The active matrix substrate (or display) as set forth in claim 1, wherein said line other than the second bus lines is a signal line for a dummy pixel.

9. A display, comprising an active matrix substrate including:

first bus lines and second bus lines arranged to form a matrix;

switching devices provided near respective intersections of the first bus lines and the second bus lines; and pixel electrodes electrically connected to the first bus lines and the second bus lines through the switching devices, wherein:

at least one of the first bus lines has a first capacitance formed thereon, the first bus lines, except for the at least one first bus line with a first capacitance, are connected to first bus lines on another active matrix substrate, and the first capacitance is formed by arranging (i) a first bus line not connected to first bus lines on another active matrix substrate and (ii) a line other than the second bus lines to cross each other.

10. The display as set forth in claim 9, wherein an amount of the first capacitance is such that there is substantially no difference in signal delay on each first bus line of the active matrix substrate that is connected to a first bus line on the other active matrix substrate and signal delay on the at least one first bus line with a first capacitance.

11. The display as set forth in claim 9, wherein the active matrix substrate has a display area and the first capacitance is formed outside the display area.

12. The display as set forth in claim 9, wherein said line other than the second bus lines is a signal line for a dummy pixel.

13. A display, comprising display panels each including an active matrix substrate including:

first bus lines and second bus lines arranged to form a matrix;

switching devices provided near respective intersections of the first bus lines and the second bus lines; and pixel electrodes electrically connected to the first bus lines and the second bus lines through the switching devices, wherein:

at least one of the first bus lines has a first capacitance formed thereon, the first bus lines, except for the at least one first bus line with a first capacitance, are shared for use among the active matrix substrates in the display panels, and the first capacitance is formed by arranging (i) a first bus line that is on an active matrix substrate and that is not shared for use with another active matrix substrate and (ii) a line other than the second bus lines to cross each other.

14. The display as set forth in claim 13, wherein the first bus lines shared among the display panels each have a second capacitance formed thereon which is less than the first capacitance.

15. The display as set forth in claim 13, further comprising a source driver and a gate driver for applying a signal voltage to the first bus lines and the second bus lines, wherein the first bus lines are connected to the source driver, and the second bus lines are connected to the gate driver.

16. The display as set forth in claim 13, further comprising a source driver and a gate driver for applying a signal voltage to the first bus lines and the second bus lines, wherein the first bus lines are connected to the gate driver, and the second bus lines are connected to the source driver.

17. The display as set forth in claim 13, wherein one of the display panels is designated as a main panel, and the display panels, except for the main panel, are designated as sub-panels having less display pixels than the main panel.

18. The display as set forth in claim 13, wherein an amount of the first capacitance is such that there is substantially no difference in signal delay on each first bus line that is shared for use among the active matrix substrates in the display panels and signal delay on the at least one first bus line with a first capacitance.

19. The display as set forth in claim 13, wherein the active matrix substrate has a display area and the first capacitance is formed outs i d e the display area.

20. The display as set forth in claim 13, wherein said line other than the second bus lines is a signal line for a dummy pixel.

21. A display, comprising display panels each including an active matrix substrate including:

first bus lines and second bus lines arranged to form a matrix;

switching devices provided near respective intersections of the first bus lines and the second bus lines; and pixel electrodes electrically connected to the first bus lines and the second bus lines through the switching devices, wherein:

the first bus lines are shared for use among the display panels, in at least one of the display panels, at least one of the first bus lines is connected to none of the pixel electrodes on the active matrix substrate, the at least one first bus line connected to none of the pixel electrodes has a first capacitance formed thereon, and the first capacitance is formed by arranging (i) a first bus line not connected to the pixel electrodes and (ii) a line other than the second bus lines to cross each other.

22. The display as set forth in claim 21, wherein each of those first bus lines which have no first capacitance formed thereon has a second capacitance formed thereon which is less than the first capacitance.

23. The display as set forth in claim 21, further comprising a source driver and a gate driver for applying a signal voltage to the first bus lines and the second bus lines, wherein the first bus lines are connected to the source driver, and the second bus lines are connected to the gate driver.

24. The display as set forth in claim 21, further comprising a source driver and a gate driver for applying a signal voltage to the first bus lines and the second bus lines, wherein the first bus lines are connected to the gate driver, and the second bus lines are connected to the source driver.

25. The display as set forth in claim 21, wherein one of the display panels is designated as a main panel, and the display panels, except for the main panel, are designated as sub-panels having less display pixels than the main panel.

26. The display as set forth in claim 21, wherein an amount of the first capacitance is such that there is substantially no difference in signal delay on each first bus line that is shared for use among the display panels and signal delay on the at least one the first bus line with a first capacitance.

27. The display as set forth in claim 21, wherein the active matrix substrate has a display area and the first capacitance is formed outside the display area.

28. The display as set forth in claim 21, wherein said line other than the second bus lines is a signal line for a dummy pixel.

* * * * *